US010016033B2

(12) United States Patent
Volin

(10) Patent No.: US 10,016,033 B2
(45) Date of Patent: Jul. 10, 2018

(54) ADJUSTABLE CANOPY UMBRELLA WITH AUDITORY PIN LOCKING AND CENTERING SYSTEM

(71) Applicant: Dee Volin, Fairview, OR (US)

(72) Inventor: Dee Volin, Fairview, OR (US)

( * ) Notice: Subject to any disclaimer, the term of this patent is extended or adjusted under 35 U.S.C. 154(b) by 0 days.

(21) Appl. No.: 15/494,429

(22) Filed: Apr. 21, 2017

(65) Prior Publication Data

US 2017/0340075 A1 Nov. 30, 2017

Related U.S. Application Data

(60) Provisional application No. 62/343,344, filed on May 31, 2016.

(51) Int. Cl.

| | |
|---|---|
| ***A45B 25/02*** | (2006.01) |
| ***A45B 25/08*** | (2006.01) |
| ***A45B 25/14*** | (2006.01) |
| ***A45B 25/18*** | (2006.01) |
| *A45B 19/10* | (2006.01) |

(52) U.S. Cl.

CPC ..... *A45B 25/08* (2013.01); *A45B 25/02* (2013.01); *A45B 25/14* (2013.01); *A45B 25/18* (2013.01); *A45B 19/10* (2013.01)

(58) Field of Classification Search

CPC ..... A45B 25/02; A45B 25/06; A45B 25/08; A45B 25/14; A45B 25/146; A45B 25/18

See application file for complete search history.

(56) References Cited

U.S. PATENT DOCUMENTS

| | | | | |
|---|---|---|---|---|
| 4,567,907 | A | 2/1986 | Dubinsky | |
| 4,993,445 | A | 2/1991 | Dubinsky | |
| 5,617,888 | A | 4/1997 | Wu | |
| 5,640,984 | A | 6/1997 | Dubinsky | |
| 5,752,534 | A | 5/1998 | Becher | |
| 6,129,101 | A | 10/2000 | Dubinsky | |
| 6,173,721 | B1 | 1/2001 | Mery | |
| 6,314,976 | B1 | 11/2001 | Clarke | |
| 6,386,214 | B1 * | 5/2002 | Clarke | A45B 25/02 135/16 |

(Continued)

*Primary Examiner* — David R Dunn
*Assistant Examiner* — Danielle Jackson

(57) ABSTRACT

An arthritic-aiding pin-centering-and-guiding auditorily-snap-locking umbrella comprising: a canopy having tension-adjusting oval openings, a pole having a fixed hub and a movable hub, tension-adjusting rods, rod-locking screws respectively screwed through the tension-adjusting oval openings and into the tension-adjusting rod, three pulleys respectively screwed to the fixed hub and the movable hub, a pulley cord threaded on the three pulleys and attached to the movable hub, a cord hook, two gear cams attached to the movable hub, a cord blocker attached to the two gear cams, at least one pin opening drilled through the pole, an arthritic-aiding grip ring attached to the cord hook, a locking pin attached to the arthritic-aiding grip ring, a recess molded on the locking pin, at least one pin-centering-and-guiding plug and tube having built-in auditorily-snap-locking leaf springs and leaf-spring towers inserted into the pole and aligned with the at least one pin opening, and a tower-locking screw screwed between the leaf-spring towers for locking the plug inside the pole.

18 Claims, 16 Drawing Sheets

(56) References Cited

U.S. PATENT DOCUMENTS

| | | | | |
|---|---|---|---|---|
| 6,889,699 | B2 * | 5/2005 | Clarke | A45B 23/00 135/20.3 |
| 6,945,263 | B2 | 9/2005 | Li | |
| 7,293,573 | B2 | 11/2007 | Clarke | |
| 7,438,077 | B1 | 10/2008 | Wilson | |
| 7,665,477 | B1 | 2/2010 | Hathaway | |
| 7,992,581 | B2 | 8/2011 | Hoogendoorn | |
| 8,061,375 | B2 | 11/2011 | Ma | |
| 8,082,935 | B2 | 12/2011 | Ma | |
| 8,096,310 | B2 | 1/2012 | Clarke | |
| 8,136,541 | B2 | 3/2012 | Beaulieu | |
| 8,443,819 | B2 | 5/2013 | Beaulieu | |
| 8,511,327 | B2 | 8/2013 | Sun | |
| D700,772 | S | 3/2014 | Akin | |
| D704,428 | S | 5/2014 | Akin | |
| D756,623 | S | 5/2016 | Akin | |
| 9,339,092 | B2 | 5/2016 | Vaitl | |
| 9,554,630 | B1 | 1/2017 | Patel | |
| 2004/0206383 | A1 * | 10/2004 | Clarke | A45B 25/02 135/41 |
| 2006/0090784 | A1 | 5/2006 | Ma | |
| 2007/0062565 | A1 * | 3/2007 | Clarke | A45B 25/02 135/16 |
| 2009/0223545 | A1 | 9/2009 | Beyer | |
| 2010/0175732 | A1 * | 7/2010 | Ma | A45B 25/08 135/135 |
| 2010/0288318 | A1 | 11/2010 | Beaulieu | |
| 2011/0017249 | A1 * | 1/2011 | Ma | A45B 25/08 135/39 |
| 2011/0132418 | A1 * | 6/2011 | Ma | A45B 25/08 135/37 |
| 2014/0109942 | A1 | 4/2014 | Ma | |

* cited by examiner

FIG. 5A
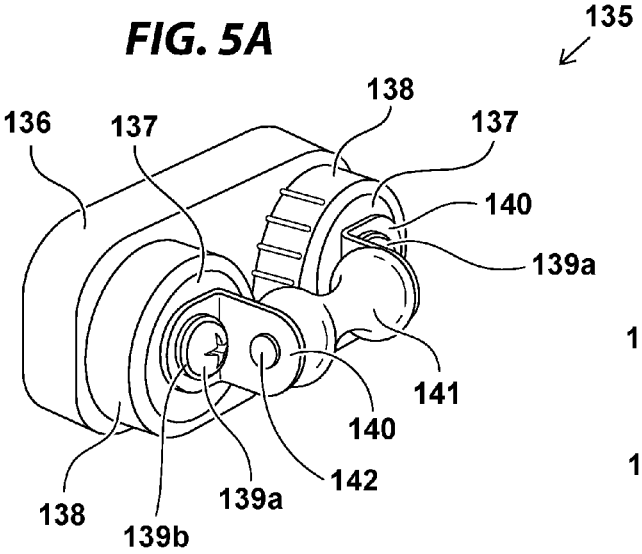
FIG. 5B
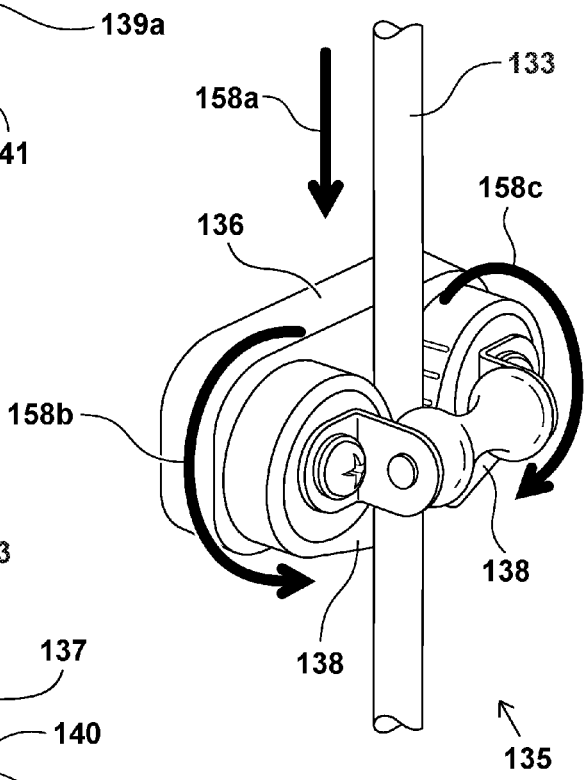
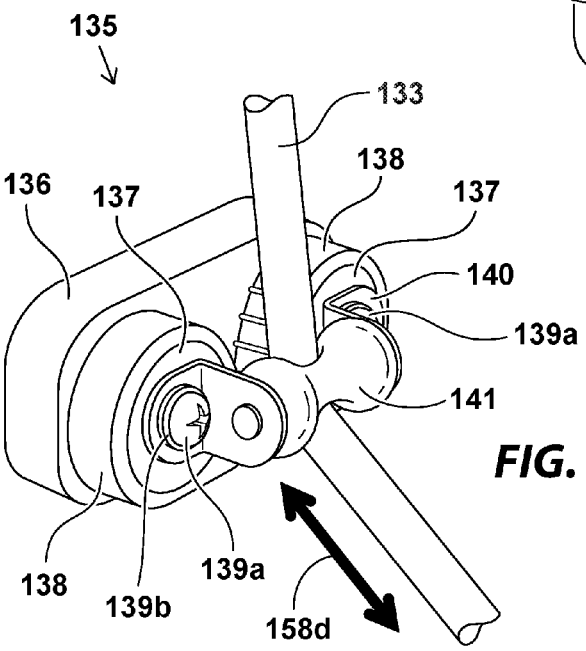
FIG. 5C

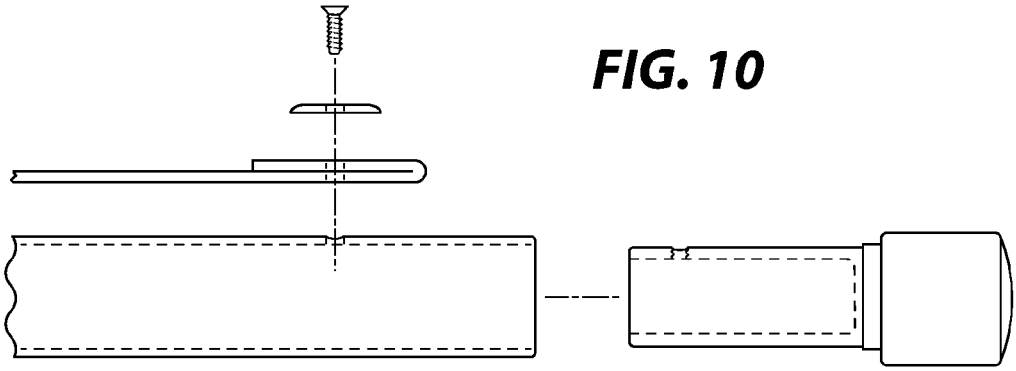
FIG. 10
FIG. 11
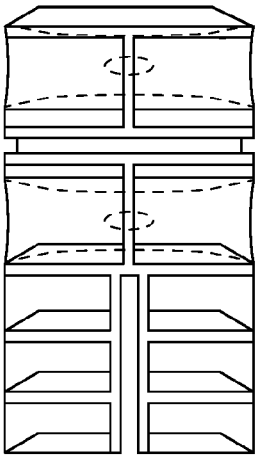
FIG. 12
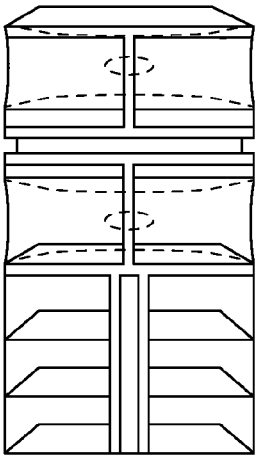

ADJUSTABLE CANOPY UMBRELLA WITH AUDITORY PIN LOCKING AND CENTERING SYSTEM

FIELD OF THE INVENTION

The present invention relates to a foldable umbrella, which is cheap to produce, is easy to ship as one unit, can be quickly and easily assembled, and can be quickly and easily unfolded. Particularly, the present invention relates to a unique umbrella system, having:

1) A canopy and pole system,
2) An arthritic-aiding canopy-tension-adjusting system,
3) A fixed rib-hub system,
4) A movable rib-hub system,
5) An arthritic-aiding tri-pulley system,
6) An anti-cable-fraying cable-locking gear-cam system, and
7) An arthritic-aiding pin-centering pin-guiding auditorily-snap-locking tower-locking system.

DESCRIPTION OF THE PRIOR ART

A number of foldable umbrellas have been introduced.

U.S. Pat. No 4,567,907, issued 1986 Feb. 4, to Emanuel Dubinsky, describes a pulley system for opening and closing an umbrella which has a ribholder adapted for slidable movement along an umbrella pole. A pulley wheel is mounted in the umbrella pole below its top portion with one end of a pulley cord fixedly attached to the ribholder while the other end of the pulley cord extends below the closed umbrella cover with a first cord handle adapted for being grasped by an operator.

U.S. Pat. No. 4,993,445, issued 1991 Feb. 19, to Emanuel Dubinsky, refers to a solid wood pole garden umbrella that is built to permit a hand crank and pulley system to slidably move a ribholder vertically along such wood pole for opening and closing the umbrella. A pulley wheel is mounted in the umbrella pole below its top portion, with one end of a pulley cord attached to the ribholder while the other end of the pulley cord extends through a narrow groove formed longitudinally along the side of the pole down to a lower pole portion where such pulley cord is operatively connected to the hand crank.

U.S. Pat. No. 5,617,888, issued 1997 Apr. 8, to Nick Wu, refers to a garden umbrella made of a solid wood pole, which is designed to accommodate the pulley cord within a specially drilled cord passage located adjacent to a narrow neck slot extending longitudinally between the pulley, located at the top of the pole, and the hand crank near the bottom of the pole.

U.S. Pat. No. 5,640,984, issued 1997 Jun. 24, to Emanuel Dubinsky, reveals a garden umbrella employing an upper canopy extending from the top of the umbrella pole to the middle of long canopy ribs, and a lower outer canopy extending in a ring around the outer part of the umbrella and having long sleeves sewn across the canopy in a radial pattern for receiving a canopy rib in each sleeve. The canopy ribs are pivotally connected to a runner notch, while the other ends of the canopy ribs are received in the canopy sleeves.

U.S. Pat. No. 5,752,534, issued 1998 May 19, to Karl Klaus Becher, details an umbrella, particularly a standing umbrella, sunshade, garden umbrella or similar, with a frame, a roof structure and a canopy, where the roof rods (5) are linked to a pole element (2) bearing a cap (3) and moveable in a telescopic manner relative to the vertical pipe (1), and a slide (4), on which stretchers (6) linked to the roof rods (5) act flexibly, is moveable along the vertical pipe (1), the cap (3) and the slide (4) moving in opposite directions during opening and closing of the umbrella, and with at least one additional stretcher (8) arranged flexibly above the slide (4) between the umbrella pipe (1) and a roof rod (5), the slide (4) being fitted with a locking device (12) with which it can be locked in its upper position and the canopy can be tensioned, it is envisaged that the locking device (12) works in conjunction with a retaining device (13) located on the cap (3) or the moveable pole element (2) to enable simple manual opening of the umbrella and stretching of the canopy, particularly for umbrellas with large diameters.

U.S. Pat. No. 6,129,101, issued 2000 Nov. 10, to Emanuel Dubinsky, demonstrates a garden umbrella of a generally large size, having a ribholder runner notch adapted for movement along a hollow umbrella pole for operating the canopy ribs to open and close the umbrella canopy. A pulley wheel is mounted in the umbrella pole below its top portion, with one end of a pulley cord being attached to the ribholder runner notch while the other end of the pulley cord extends down through the hollow pole where it connects to a ballast weight. The ballast weight is adapted to travel vertically in the pole in synchronism with movement of the runner notch.

U.S. Pat. No. 6,173,721, issued 2001 Jan. 16, to Johni Mery, describes a patio umbrella that has a pole which has an opening extending therethrough. The patio umbrella has a plurality of ribs for supporting and umbrella covering, and a runner adapted to slide along the pole and coupled to the ribs. The patio umbrella further includes a pulley system that has a first pulley member secured to a first side of the pole, a second pulley member coupled to the runner on the first side of the pole, a wheel positioned inside the opening of the pole, and a pulley rope. The pulley rope has a first end secured to the second pulley member and passes through the first and second pulley members, and then through the wheel inside the opening of the pole, to a free end that is positioned on a side of the pole that is opposite to the first side.

U.S. Pat. No. 6,314,976, issued 2001 Nov. 13, to Dougan H. Clarke, outlines an umbrella frame which provides a stable and enduring support for an umbrella canopy while also allowing canopies of varying shapes and sizes to be mounted thereto. The umbrella frame includes a pair of hub members mounted about a pole member wherein each hub member has a plurality of slots formed in its outer perimeter. Ribs and struts are pivotally secured to the hub members using hub connectors which are removably secured to the hub slots so as to allow the size and shape of the attached canopy to be readily varied.

U.S. Pat. No. 6,945,263, issued 2005 Sep. 20, to Wanda Ying Li, demonstrates an outdoor umbrella which includes an operation device including a ring-shaped slider joint slidably connected to a shaft of the outdoor umbrella in a vertical movable manner, a locking stopper fitted in a locker hole of the shaft in an inwardly movable manner, a resilient unit for applying an urging pressure against the locking stopper to normally urge and retain the locking stopper extending into the locker hole so as to lock up the slider joint on the shaft, and a handle device for driving the locking stopper in an outwardly movable manner to move away from the locker hole so as to unlock the slider joint from the shaft.

U.S. Pat. No. 7,293,573, issued 2007 Nov. 13, to Dougan H. Clarke, defines an improved, durable and versatile umbrella frame assembly and is provided to more readily endure abusive weather conditions and that may be quickly, easily and inexpensively repaired. In addition, the assembly is also easily modified to accommodate umbrella canopies of different sizes and shapes. In addition, an improved umbrella operating system is provided to permit simple opening, positioning, and locking of an umbrella while allowing the frame to freely rotate about the pole regardless of the degree to which it is opened, while the pole is held in a stationary position.

U.S. Pat. No. 7,438,077, issued 2008 Oct. 21, to Robert J. Wilson, demonstrates that this umbrella has an intermediate point of equilibrium between its fully open and closed positions, which reduces the peak force required to move the umbrella in either direction. To actuate the umbrella, a resiliently flexible steel band is able to not only carry tension to pull the umbrella open, but the band also has sufficient rigidity to operate in compression to push the umbrella closed. The band's flexibility allows it to feed through a small sidewall hole in the mast as well as snake through a hinge on an umbrella mast that can tilt.

U.S. Pat. No. 7,665,477, issued 2010 Feb. 23, to Martin Hathaway, outlines an outdoor umbrella that closes automatically in high wind. The wind causes the main support post of the umbrella to flex from the vertical dislodging a plunger from its weight bearing mounting on a rigid rod. The plunger is attached to an actuator rod extending upward within the support post. When the plunger is displaced the actuator rod is caused to move downward thereby activating a releasing ratchet which frees a shaft to rotate and the cable which holds the canopy to unwind.

U.S. Pat. No. 7,992,581, issued 2011 Aug. 9, to Gerrit Hoogendoorn, pertains to the present invention which relates to a canopy device, in particular an umbrella or parasol, comprising: a rod; a canopy of flexible material connected to the rod close to an end thereof; operating means displaceable along the rod for closing or opening the canopy; and means for tensioning the canopy, which canopy tensioning means comprise a set of first tensioning members and a set of second tensioning members, wherein the first tensioning members are each pivotally connected with one first outer end to the rod and extend therefrom along the canopy to a position close to the periphery thereof.

U.S. Pat. No. 8,061,375, issued 2011 Nov. 22, to Oliver Joen-an Ma, outlines the present invention which relates generally to connectors for interconnecting members of shade structures (e.g. umbrellas and pavilions), such as support ribs and hubs. The connectors can be incorporated or attached to support ribs of shade structures to enable the support ribs to extend from the hubs at various angles to accommodate different shaped canopies.

U.S. Pat. No. 8,082,935, issued 2011 Dec. 27, to Oliver Joen-an Ma, refers to a connector that is provided for connecting a first portion of a shade structure to a second portion of the structure. The connector can have a first end that can be mechanically coupled with the first portion and a second end that can be mechanically coupled with the second portion of the structure. The second end can have a reinforced portion and an engagement member that extends from the reinforced portion to be movable into and out of the reinforced portion.

U.S. Pat. No. 8,096,310, issued 2012 Jan. 17 to Dougan H. Clarke, describes an umbrella frame structured for use in a strong wind conditions such as those conditions frequently encountered on a boat traveling at relatively high speeds. An umbrella frame assembly includes a reinforcing assembly connected thereto in a supportive, operative orientation thereby providing a stable support for an umbrella canopy which can remain open even during travel of the boat. The frame assembly can be modified to support canopies of varying shapes and size.

U.S. Pat. No 8,136,541, issued 2012 Mar. 20, to Peter John Beaulieu, details an umbrella assembly and various embodiments of hub assemblies which provide an umbrellas assembly which is easy to install or remove, is extremely rigid, and is capable of withstanding high wind gusts and other high external forces. A first hub assembly includes a mounting bracket having extended regions for mounting to a hub. A second hub assembly includes securing rings for securely binding mounting brackets to a hub. A third hub assembly includes a mortise-tenon mounting bracket.

U.S. Pat. No. 8,443,819, issued 2013 May 21, to Peter John Beaulieu, describes an umbrella assembly and various embodiments of hub assemblies which provide an umbrellas assembly which is easy to install or remove, is extremely rigid, and is capable of withstanding high wind gusts and other high external forces. A rotatable fabric connector having a plurality of curved surfaces on the head of the fabric connector is present.

U.S. Pat. No. 8,511,327, issued 2013 Aug. 20, to Min Li Sun, pertains to the invention that provides an anti-wind eccentric umbrella, with a shaft, a framework, an upper ring, a lower ring and a canopy, in which the framework is composed of ribs, stretchers and a main frame. The two ends on one side of a main frame that is cross-hinged by a first main brace and a second main brace through a main frame hinge axis are respectively hinged with the upper ring and the lower ring.

U.S. Pat. No. 9,339,092, issued 2016 May 17, to Rolf Vaitl, demonstrates an inflatable umbrella which has an inflatable covering made from a flexible material. In an inflated state, said covering forms at least the following elements: a central holding element, at least three umbrella strut elements extending away from the central holding element, and at least one umbrella surface element stretched out by the umbrella strut elements.

U.S. Pat. No. 9,554,630, issued 2017 Jan. 31, to Vinod Patel, relates to an umbrella that has a lower pole and an upper pole and a fabric. The lower pole includes screw threads. A spring clip in an inverted V-shaped configuration has outwardly extending projections removably coupling together the upper pole and the lower pole. A handle is removably coupled to the lower pole to twist the lower pole. Each rib of a plurality of ribs has an interior end and an exterior end.

U.S. Pat. No. D700,772, issued 2014 Mar. 11, to Sarah Akin, depicts the ornamental design for an umbrella cap, as shown described.

U.S. Pat. No. D704,428, issued 2014 May 13, to Sarah Akin, depicts the ornamental design for an umbrella cap, as shown and described.

U.S. Pat. No. D756,623, issued 2016 May 24, to Sarah Akin, depicts the ornamental design for an umbrella cap, as shown and described.

U.S. Patent No. 20060090784, issued 2006 May 4, to Oliver Joen-an Ma, demonstrates an umbrella that includes a support pole assembly, a canopy support frame, and an actuating handle. The support pole assembly includes a lower pole and an upper pole. The lower pole has a lower end and an upper end. The upper pole is vertically translatable relative to the lower pole.

U.S. Patent No. 20090223545, issued 2009 Sep. 10, to Andrea Eglin Beyer, demonstrates an umbrella system, substantially comprising an umbrella with elements that include a hollow shaft, a cover, as well as a frame consisting of ribs and stretchers mounted on the exterior of the hollow shaft. When retracted, the cover is stowed inside the shaft. When deployed, the umbrella's cover is supported by ribs and stretchers as well as by the shaft.

U.S. Patent No. 20100288318, issued 2010 Nov. 18, to Peter John Beaulieu, relates to an umbrella assembly and various embodiments of hub assemblies which provide an umbrellas assembly which is easy to install or remove, is extremely rigid, and is capable of withstanding high wind gusts and other high external forces. A first hub assembly includes a mounting bracket having extended regions for mounting to a hub.

U.S. Patent No. 20140109942, issued 2014 Apr. 24, to Oliver Joen-an Ma, refers to an umbrella assembly described herein, which is advantageously configured with simple yet robust arrangements for securing an umbrella in an open configuration, e.g., with a runner in an elevated position.

DISADVANTAGES OF THE PRIOR ART

The prior art have failed to solve many problems associated with such foldable umbrellas, as follows:

1) No prior art mention or disclose any foldable umbrella, having an arthritic-aiding cord-hook grip ring and an anti-finger-pinching spacer.
   Therefore, the prior art of foldable umbrella:
   a) Can not encircle the broad surface of the metacarpals of the palm of the hand or the broad surface of the union of the metacarpals with the base of the phalanges,
      to provide an enlarged surface area to engage with the palm of an open hand to insert a locking pin, providing greater comfort and availability to an arthritic suffering person (FIGS. 6, 7A, 7B and 8A);
   b) Can not encircle the broad surface of the metacarpals of the back of the hand or the broad surface of the union of the metacarpals with the base of the phalanges,
      to provide an enlarged surface area; to engage with the back of an open hand; to extract a locking pin, providing greater comfort and availability to an arthritic suffering person (FIGS. 6, 7A, 7B and 8A);
   c) Can not allow a user with an arthritic hand to keep his/her hand straight,
      to eliminate the needs for bending ones' fingers and wrist when holding and operating arthritic-aiding cord-hook grip ring (FIGS. 6, 7A, and 7B); and
   d) Can not allow a user with an arthritic hand to keep his/her hand straight,
      to render access to the interior of the hook section, for conveniently storing a coiled excess portion of a pulley cord (FIGS. 3D, 6, 7A, 7B and 8A).
2) No prior art mention or disclose any foldable umbrella, having four auditorily-snap-locking leaf springs, four auditorily- snap-locking nipples, and an auditorily-snap-locking recess.
   Therefore, the prior art of foldable umbrella:
   a) Can not emit a snapping sound loud enough,
      to allow a person to hear the sound and recognize the moment that a locking pin is fully engaged (FIGS. 8A, 8B, 8C, and 8D);
   b) Can not transmit a vibration-emitting movement, projected by an interaction between two of four auditorily-snap-locking nipples,
      to allow a person, utilizing their tactile senses, to recognize the moment a locking pin has fully engaged (FIGS. 8A, 8B, 8C, and 8D);
   c) Can not lock with one action,
      to eliminate the need to secondarily insert a cotter key, or split-wire ring, to secure pin in vertical post (FIGS. 7A, 7B, 8A, 8B, 8C, and 8D); and
   d) Can not easily and instantly be inserted and extracted with minimal effort,
      to eliminate pain experienced by an arthritic person (FIGS. 7A, 7B, 8A, 8B, 8C, and 8D).
3) No prior art mention or disclose any foldable umbrella, having an arthritic-aiding canopy-tension-adjusting system.
   Therefore, the prior art of foldable umbrella:
   a) Can not easily adjust,
      to compensate for conditions resulting in canopy fabric being too small or too tight (FIGS. 4A, 4B, 4C, and 4D);
   b) Can not easily adjust,
      to compensate for conditions which loosen the canopy fabric causing sagging (FIGS. 4A, 4B, 4C, and 4D); and
   c) Can not provide internally-threaded tension-adjusting knobs whose flat surface can be easily rotated open-handed, by an arthritic hand,
      to eliminate the need to curl fingers to rotate, causing pain to an arthritic suffering person (FIGS. 4A, 4B, 4C, and 4D).
4) No prior art mention or disclose any foldable umbrella, having two pin-centering pin-guiding tubes.
   Therefore, the prior art of foldable umbrella:
   a) Can not provide two tapered cone-shaped receiving apertures, on opposing ends, acting as a funnel while an arthritic suffering person inserts a locking pin,
      to aid shaky arthritic hand to easily locate the tip of a locking pin to the inwardly tapered cone-shaped receiving apertures (FIGS. 7A, 7B, 8A, 8B, 8C, and 8D);
   b) Can not provide a conduit between two umbrella-pole pin openings,
      to eliminate difficulty lining up common pin holes on either side for an arthritic hand (FIGS. 7A, 7B, 8A, 8B, 8C, and 8D);
   c) Can not provide a very low-friction material and low-friction internal surface,
      to aid a shaky arthritic hand to effortlessly slide a locking pin into and through the two pin-centering pin-guiding tubes (FIGS. 7A, 7B, 8A, 8B, 8C, and 8D); and
   d) Can not provide two inwardly tapered cone-shaped receiving apertures, on opposing ends,
      to provide greater access to, and increase comfort for a painful arthritic hand (FIGS. 7A, 7B, 8A, 8B, 8C, and 8D).
5) No. prior art mention or disclose any foldable umbrella, having four internally-taperedly-threaded flexible towers.
   Therefore, the prior art of foldable umbrella:
   a) Can not simply be inserted from the top or bottom of an umbrella pole,
      to overcome the need to have special tooling and reduce costs, materials, and labor (FIGS. 9A, 9B, 9C, 9D and 9E);
   b) Can not secure within an umbrella pole, by the turn of a tower-locking screw, to lock them in position, using a simple method, designed to reduce costs, materials, and labor (FIGS. 9A, 9B, 9C, 9D and 9E);

c) Can not provide a cost-saving manufacturing method by being molded into a one-piece unit;

to reduce manufacturing costs and conserve molding materials (FIGS. 9A, 9B, 9C, 9D and 9E); and d) Can not provide a cost-saving manufacturing method by being molded into a one-piece unit to reduce labor during assembly (FIGS. 9A, 9B, 9C, 9D and 9E).

6) No prior art mention or disclose any foldable umbrella, having twelve triangular tower leaf springs.

Therefore, the prior art of foldable umbrella:

a) Can not create a low-pressure friction fit within an umbrella pole, with respectively evenly-distributed pressure around the perimeter, to securely position the arthritic-aiding pin-centering pin-guiding auditorily-snap-locking tower-locking system with minimal pressure being exerted against the internal structure of an umbrella pole (FIGS. 9A, 9B, 9C, 9D and 9E);

b) Can not create a low-pressure friction fit within an umbrella pole, to prevent over-tightening of the four internally-taperedly-threaded flexible towers during assembly (FIGS. 9A, 9B, 9C, 9D and 9E);

c) Can not provide a cost-saving manufacturing technique, to reduce manufacturing costs and conserve molding materials (FIGS. 9A, 9B, 9C, 9D and 9E); and d) Can not provide arched leaf springs, creating an evenly-distributed-pressure friction fit within an umbrella pole, to exert adequate outward pressure, without exerting excessive pressure, and self-adjust as needed in response to environmental conditions (FIGS. 9A, 9B, 9C, 9D and 9E).

7) No prior art mention or disclose any foldable umbrella, having an anti-cable-fraying cable-locking gear-cam system.

Therefore, the prior art of foldable umbrella:

a) Can not overcome common impediments of prior art, to allow an arthritic sufferer to utilize the umbrella system (FIG. 1 (Prior Art);

b) Can not overcome the need required by prior art, to curl thumb and fingers of a single hand around a pole to engage the locking pin, to insert or compress a spring activated pin, or a manually inserted pin, into vertical umbrella center pole pin hole (FIG. 1 (Prior Art);

c) Can not allow opposing pressure from between thumb and fingers of a single hand around a pole to engage the locking pin, to insert or compress a spring activated pin, or a manually inserted pin, into vertical umbrella center pole pin hole (FIG. 1 (Prior Art); and d) Can not allow opposing pressure from another hand, such as an opposing left hand or an opposing right hand, to insert or compress a spring activated pin, or a manually inserted pin, into vertical umbrella center pole pin hole (FIG. 1 (Prior Art).

8) No prior art mention or disclose any foldable umbrella, having an anti-cable-fraying cable-locking gear-cam system.

Therefore, the prior art of foldable umbrella:

a) Can not provide a greater surface area in contact with a pulley cord, to reduce concentrated friction encountered by their interaction, resulting in less wear and increased useable material life (FIGS. 2 (Prior Art), 5A, 5B, and 5C);

b) Can not provide a smoother surface area in contact with a pulley cord, to reduce concentrated friction encountered by their interaction, resulting in less wear, and increased useable material life (FIGS. 2 (Prior Art), 5A, 5B, and 5C);

c) Can not provide a rolling surface area in contact with a pulley cord, to reduce concentrated friction encountered by their interaction, resulting in less wear, and increased useable material life (FIGS. 2 (Prior Art), 5A, 5B, and 5C);

d) Can not provide a rolling surface area in contact with a pulley cord, to simplify the pulling effort required by the hands of an arthritic suffering person (FIGS. 2 (Prior Art), 5A, 5B, and 5C); and e) Can not provide an hourglass-shaped rolling surface area in contact with a pulley cord, to allow a pulley cord to glide along its surface, while being pulled or released at a large range of different angles (FIGS. 2 (Prior Art), 5A, 5B, and 5C).

OBJECTS AND ADVANTAGES OF THE INVENTION

The present invention substantially departs from the conventional concepts and designs of the prior art. In doing so, the present invention provides a unique canopy-tension-adjusting arthritic-aiding tri-pulley anti-cable-fraying pin-centering pin-guiding auditorily-snap-locking tower-lockin g umbrella system (having: a) Canopy and pole system, b) Arthritic-aiding canopy-tension-adjusting system, c) Fixed rib-hub system, d) Movable rib-hub system, e) Arthritic-aiding tri-pulley system, f) Anti-cable-fraying cable-locking gear-cam system g) Arthritic-aiding pin-centering pin-guiding auditorily-snap-locking tower-locking system) having many unique and significant features, functions, and advantages, which overcome all the disadvantages of the prior art, as follows:

1) It is still another object of the new invention to provide a unique canopy-tension-adjusting arthritic-aiding tri-pulley anti-cable-fraying pin-centering pin-guiding auditorily-snap-locking tower-locking umbrella system, having an arthritic-aiding cord-hook grip ring and an anti-finger-pinching spacer.

Therefore, the unique canopy-tension-adjusting arthritic-aiding tri-pulley anti-cable-fraying pin-centering pin-guiding auditorily-snap-locking tower-locking umbrella system:

a) Can encircle the broad surface of the metacarpals of the palm of the hand or the broad surface of the union of the metacarpals with the base of the phalanges, to provide an enlarged surface area to engage with the palm of an open hand to insert a locking pin, providing greater comfort and availability to an arthritic suffering person (FIGS. 6, 7A, 7B and 8A);

b) Can encircle the broad surface of the metacarpals of the back of the hand or the broad surface of the union of the metacarpals with the base of the phalanges, to provide an enlarged surface area; to engage with the back of an open hand; to extract a locking pin, providing greater comfort and availability to an arthritic suffering person (FIGS. 6, 7A, 7B and 8A);

c) Can allow a user with an arthritic hand to keep his/her hand straight, to eliminate the needs to bend ones' fingers and wrist when holding and operating arthritic-aiding cord-hook grip ring (FIGS. 6, 7A, and 7B); and d) Can allow a user with an arthritic hand to keep his/her hand straight, to render access to the interior of the hook section, for conveniently storing a coiled excess portion of a pulley cord (FIGS. 3D, 6, 7A, 7B and 8A).

2) It is a further object of the new invention to provide a unique canopy-tension-adjusting arthritic-aiding tri-pulley anti-cable-fraying pin-centering pin-guiding auditorily-snap-locking tower-locking umbrella system, having four auditorily-snap-locking leaf springs, four auditorily-snap-locking nipples, and an auditorily-snap-locking recess.

Therefore, the unique canopy-tension-adjusting arthritic-aiding tri-pulley anti-cable-fraying pin-centering pin-guiding auditorily-snap-locking tower-locking umbrella system:

a) Can emit a snapping sound loud enough to allow a person to hear the sound and recognize the moment that a locking pin is fully engaged (FIGS. 8A, 8B, 8C, and 8D);

b) Can transmit a vibration-emitting movement, projected by an interaction between two of four auditorily-snap-locking nipples, to allow a person, utilizing their tactile senses, to recognize the moment a locking pin has fully engaged (FIGS. 8A, 8B, 8C, and 8D);

c) Can lock with one action, to eliminate the need to secondarily insert a cotter key, or split-wire ring, to secure pin in vertical post (FIGS. 7A, 7B, 8A, 8B, 8C, and 8D); and d) Can easily and instantly be inserted and extracted with minimal effort, to eliminate pain experienced by an arthritic person (FIGS. 7A, 7B, 8A, 8B, 8C, and 8D).

3) It is an even further object of the new invention to provide a unique canopy-tension-adjusting arthritic-aiding tri-pulley anti-cable-fraying pin-centering pin-guiding auditorily-snap-locking tower-locking umbrella system, having an arthritic-aiding canopy-tension-adjusting system.

Therefore, the unique canopy-tension-adjusting arthritic-aiding tri-pulley anti-cable-fraying pin-centering pin-guiding auditorily-snap-locking tower-locking umbrella system:

a) Can easily adjust, to compensate for conditions resulting in canopy fabric being too small or too tight (FIGS. 4A, 4B, 4C, and 4D);

b) Can easily adjust, to compensate for conditions which loosen the canopy fabric causing sagging (FIGS. 4A, 4B, 4C, and 4D); and c) Can provide internally-threaded tension-adjusting knobs whose flat surface can be easily rotated open-handed, by an arthritic hand to eliminate the need to curl fingers to rotate, causing pain to an arthritic suffering person (FIGS. 4A, 4B, 4C, and 4D).

4) It is still another object of the new invention to provide a unique canopy-tension-adjusting arthritic-aiding tri-pulley anti-cable-fraying pin-centering pin-guiding auditorily-snap-locking tower-locking umbrella system, having two pin-centering pin-guiding tubes.

Therefore, the unique canopy-tension-adjusting arthritic-aiding tri-pulley anti-cable-fraying pin-centering pin-guiding auditorily-snap-locking tower-locking umbrella system:

a) Can provide two tapered cone-shaped receiving apertures, on opposing ends, acting as a funnel while an arthritic suffering person inserts a locking pin, to aid shaky arthritic hand to easily locate the tip of a locking pin to the inwardly tapered cone-shaped receiving apertures (FIGS. 7A, 7B, 8A, 8B, 8C, and 8D);

b) Can provide a conduit between two umbrella-pole pin openings, to eliminate difficulty lining up common pin holes on either side for an arthritic hand (FIGS. 7A, 7B, 8A, 8B, 8C, and 8D);

c) Can provide a very low-friction material and low-friction internal surface, to aid a shaky arthritic hand to effortlessly slide a locking pin into and through the two pin-centering pin-guiding tubes (FIGS. 7A, 7B, 8A, 8B, 8C, and 8D); and d) Can provide two inwardly tapered cone-shaped receiving apertures, on opposing ends, to provide greater access to, and increase comfort for a painful arthritic hand (FIGS. 7A, 7B, 8A, 8B, 8C, and 8D).

5) It is yet another object of the new invention to provide a unique canopy-tension-adjusting arthritic-aiding tri-pulley anti-cable-fraying pin-centering pin-guiding auditorily-snap-locking tower-locking umbrella system, having four internally-taperedly-threaded flexible towers.

Therefore, the unique canopy-tension-adjusting arthritic-aiding tri-pulley anti-cable-fraying pin-centering pin-guiding auditorily-snap-locking tower-locking umbrella system:

a) Can simply be inserted from the top or bottom of an umbrella pole, to overcome the need to have special tooling and reduce costs, materials, and labor (FIGS. 9A, 9B, 9C, 9D and 9E);

b) Can secure within an umbrella pole, by the turn of a tower-locking screw, to lock them in position, using a simple method, designed to reduce costs, materials, and labor (FIGS. 9A, 9B, 9C, 9D and 9E);

c) Can provide a cost-saving manufacturing method by being molded into a one-piece unit, to reduce manufacturing costs and conserve molding materials (FIGS. 9A, 9B, 9C, 9D and 9E); and d) Can provide a cost-saving manufacturing method by being molded into a one-piece unit,
to reduce labor during assembly (FIGS. 9A, 9B, 9C, 9D and 9E).

6) It is still yet another object of the new invention to provide a unique canopy-tension-adjusting arthritic-aiding tri-pulley anti-cable-fraying pin-centering pin-guiding auditorily-snap-locking tower-locking umbrella system,
having twelve triangular tower leaf springs.
Therefore, the unique canopy-tension-adjusting arthritic-aiding tri-pulley anti-cable-fraying pin-centering pin-guiding auditorily-snap-locking tower-locking umbrella system:
a) Can create a low-pressure friction fit within an umbrella pole, with respectively evenly-distributed pressure around the perimeter,
to securely position the arthritic-aiding pin-centering pin-guiding auditorily-snap-locking tower-locking system with minimal pressure being exerted against the internal structure of an umbrella pole (FIGS. 9A, 9B, 9C, 9D and 9E);
b) Can create a low-pressure friction fit within an umbrella pole,
to prevent over-tightening of the four internally-taperedly-threaded flexible towers during assembly (FIGS. 9A, 9B, 9C, 9D and 9E);
c) Can provide a cost-saving manufacturing technique,
to reduce manufacturing costs and conserve molding materials (FIGS. 9A, 9B, 9C, 9D and 9E); and
d) Can provide arched leaf springs, creating an evenly-distributed-pressure friction fit within an umbrella pole,
to exert adequate outward pressure, without exerting excessive pressure, and self-adjust as needed in response to environmental conditions (FIGS. 9A, 9B, 9C, 9D and 9E).

7) It is an object of the new invention to provide a unique canopy-tension-adjusting arthritic-aiding tri-pulley anti-cable-fraying pin-centering pin-guiding auditorily-snap-locking tower-locking umbrella system,
having an anti-cable-fraying cable-locking gear-cam system.
Therefore, the unique canopy-tension-adjusting arthritic-aiding tri-pulley anti-cable-fraying pin-centering pin-guiding auditorily-snap-locking tower-locking umbrella system:
a) Can overcome common impediments of prior art,
to allow an arthritic sufferer to utilize the umbrella system (FIG. 1 (Prior Art);
b) Can overcome the need required by prior art, to curl thumb and fingers of a single hand around a pole to engage the locking pin,
to insert or compress a spring activated pin, or a manually inserted pin, into vertical umbrella center pole pin hole (FIG. 1 (Prior Art);
c) Can allow opposing pressure from between thumb and fingers of a single hand around a pole to engage the locking pin,
to insert or compress a spring activated pin, or a manually inserted pin, into vertical umbrella center pole pin hole (FIG. 1 (Prior Art); and
d) Can allow opposing pressure from another hand, such as an opposing left hand or an opposing right hand,
to insert or compress a spring activated pin, or a manually inserted pin, into vertical umbrella center pole pin hole (FIG. 1 (Prior Art).

8) It is another object of the new invention to provide a unique canopy-tension-adjusting arthritic-aiding tri-pulley anti-cable-fraying pin-centering pin-guiding auditorily-snap-locking tower-locking umbrella system,
having an anti-cable-fraying cable-locking gear-cam system.
Therefore, the unique canopy-tension-adjusting arthritic-aiding tri-pulley anti-cable-fraying pin-centering pin-guiding auditorily-snap-locking tower-locking umbrella system:
a) Can provide a greater surface area in contact with a pulley cord,
to reduce concentrated friction encountered by their interaction, resulting in less wear and increased useable material life (FIGS. 2 (Prior Art), 5A, 5B, and 5C);
b) Can provide a smoother surface area in contact with a pulley cord,
to reduce concentrated friction encountered by their interaction, resulting in less wear and increased useable material life (FIGS. 2 (Prior Art), 5A, 5B, and 5C);
c) Can provide a rolling surface area in contact with a pulley cord,
to reduce concentrated friction encountered by their interaction, resulting in less wear and increased useable material life (FIGS. 2 (Prior Art), 5A, 5B, and 5C);
d) Can provide a rolling surface area in contact with a pulley cord,
to simplify the pulling effort required by the hands of an arthritic suffering person (FIGS. 2 (Prior Art), 5A, 5B, and 5C); and
e) Can provide an hourglass-shaped rolling surface area in contact with a pulley cord,
to allow a pulley cord to glide along its surface, while being pulled or released at a large range of different angles (FIGS. 2 (Prior Art), 5A, 5B, and 5C).

Other objects and advantages of the present invention will become apparent from the consideration of the accompanying drawings and ensuing description.

BRIEF DESCRIPTION OF THE DRAWINGS

FIGS. 5A, 5B, and 5C illustrate perspective views of an anti-cable-fraying cable-locking gear-cam system.

FIG. 10 illustrates a side view of a variation of the arthritic-aiding canopy-tension-adjusting system.

FIGS. 11 and 12 illustrate front views of variations of four auditorily-snap-locking leaf springs, four auditorily-snap-locking nipples, and twelve triangular tower leaf springs.

SUMMARY OF THE INVENTION

Figure 1:
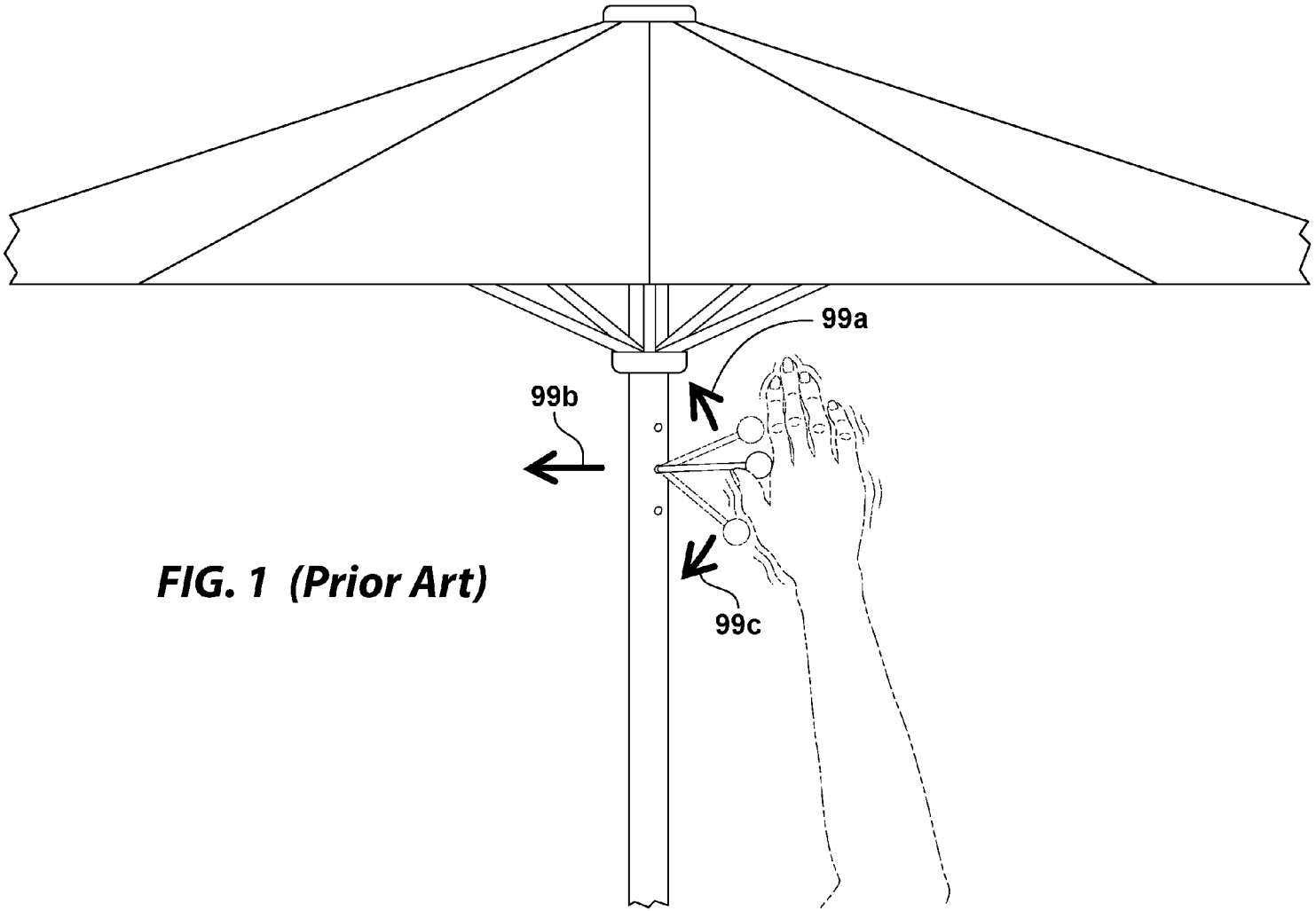
FIG. 1 (Prior Art)
FIG. 1 (Prior Art) illustrates a front view of the problems caused by a prior-art umbrella and its locking pin, which require a great deal of effort to use and are very difficult to use by a person with arthritic hands.

An arthritic-aiding pin-centering-and-guiding auditorily-snap-locking umbrella comprising: a canopy having tension-adjusting oval openings, a pole having a fixed hub and a movable hub, tension-adjusting rods, rod-locking screws respectively screwed through the tension-adjusting oval openings and into the tension-adjusting rod, three pulleys respectively screwed to the fixed hub and the movable hub, a pulley cord threaded on the three pulleys and attached to the movable hub, a cord hook, two gear cams attached to the movable hub, a cord blocker attached to the two gear cams, at least one pin opening drilled through the pole, an arthritic-aiding grip ring attached to the cord hook, a locking pin attached to the arthritic-aiding grip ring, a recess molded on the locking pin, at least one pin-centering-and-guiding plug and tube having built-in auditorily-snap-locking leaf springs and leaf-spring towers inserted into the pole and aligned with the at least one pin opening, and a tower-locking screw screwed between the leaf-spring towers for locking the plug inside the pole.

DETAILED DESCRIPTION OF THE INVENTION

Component

A unique canopy-tension-adjusting arthritic-aiding tri-pulley anti-cable-fraying pin-centering pin-guiding auditorily-snap-locking tower-locking umbrella system comprises:

1) A canopy and pole system,
2) An arthritic-aiding canopy-tension-adjusting system,
3) A fixed rib-hub system,
4) A movable rib-hub system,
5) An arthritic-aiding tri-pulley system,
6) An anti-cable-fraying cable-locking gear-cam system, and
7) An arthritic-aiding pin-centering pin-guiding auditorily-snap-locking tower-locking system.

Referring to FIGS. 3A, 3B, 3C, 3D, 4A, 4B, 4C, 4D, 5A, 5B, 5C, 6, 7A, 7B, 7C, 7D, and 7E, the unique canopy-tension-adjusting arthritic-aiding tri-pulley anti-cable-fraying pin-centering pin-guiding auditorily-snap-locking tower-locking umbrella system comprises:

1) A canopy and pole system 101, comprising:
2) A canopy 102,
3) Canopy openings 103,
4) Upper ribs 104,
5) Upper-rib screws 105,
6) Lower ribs 106,
7) Lower-rib screws 107,
8) Foldable rib joints 108, and
9) An umbrella pole 109;
10) An arthritic-aiding canopy-tension-adjusting system 110, comprising:
11) Protracting-rod-locking screws 111*a*,
Protracting-rod-locking washers 111*b*,
12) Tension-adjusting oval rib openings 112,
13) Externally-threaded protracting rods 113,
14) Threaded rod openings 114, and
15) Internally-threaded tension-adjusting knobs 115;
16) A fixed rib-hub system 116, comprising:
17) An internally-threaded crown 117,
18) A crown screw 118*a*,
A crown washer 118*b*,
19) A fixed inner hub 119,
20) A fixed outer hub 120,
21) A fixed-inner-hub plate 121, and
22) Plate screws 122;
23) A movable rib-hub system 123, comprising:
24) A movable inner hub 124,
25) A movable outer hub 125,
26) A movable tubular elevator 126, and
27) Elevator screws 127;
28) An arthritic-aiding tri-pulley system 128, comprising:
29) Two fixed-hub rotatable pulleys 129,
30) Two fixed-hub-rotatable-pulley screws 130,
31) A movable-hub rotatable pulley 131,
32) A movable-hub-rotatable-pulley screw 132, and
33) A pulley cord 133,
34) A cord hook 134;
35) An anti-cable-fraying cable-locking gear-cam system 135, comprising:
36) A gear-cam mount 136,
37) Two gear-cam bearings 137,
38) Two gear cams 138,
39) Two gear-cam screws 139*a*,
Two gear-cam washers 139*b*,
40) Two L brackets 140,
41) An hourglass-pulley 141, and
42) An hourglass-pulley rivet 142; and
43) An arthritic-aiding pin-centering pin-guiding auditorily-snap-locking tower-locking system 143, comprising:
44) Two umbrella-pole pin openings 144,
45) An arthritic-aiding cord-hook grip ring 145,
46) An anti-finger-pinching spacer 146,
47) A locking pin 147,
48) An auditorily-snap-locking recess 148,
49) Two pin-centering pin-guiding plugs 149,
50) Two pin-centering pin-guiding tubes 150,
51) Four auditorily-snap-locking leaf springs 151*a*,
Four auditorily-snap-locking nipples 151*b*,
52) Four internally-taperedly-threaded flexible towers 152,
53) Twelve triangular tower leaf springs 153, and
54) A tower-locking screw 154.

Material

Referring to FIGS. 3A, 3B, 3C, 3D, 4A, 4B, 4C, 4D, 5A, 5B, 5C, 6, 7A, 7B, 7C, 7D, and 7E:

1) Canopy and pole system 101 is made up of the combined materials of its components.
2) Canopy 102 is made up of canvas material.
3) Canopy openings 103 each are made of empty space.
4) Upper ribs 104 each are made of metallic material.
5) Upper-rib screws 105 each are made of metallic material.
6) Lower ribs 106 each are made of metallic material.

7) Lower-rib screws 107 each are made of metallic or plastic material.
8) Foldable rib joints 108 each are made of plastic material.
9) Umbrella pole 109 is made of metallic material.
10) Arthritic-aiding canopy-tension-adjusting system 110 is made of the combined materials of its components.
11) Protracting-rod-locking screws 111*a* each are made of metallic material.
Protracting-rod-locking washers 111*b* each are made of metallic material.
12) Tension-adjusting oval rib openings 112 each are made of empty space.
13) Externally-threaded protracting rods 113 each are made of metallic material.
14) Threaded rod openings 114 each are made of empty space.
15) Internally-threaded tension-adjusting knobs 115 each are made of metallic material.
16) Fixed rib-hub system 116 is made of the combined materials of its components.
17) Internally-threaded crown 117 is made up of metallic material.
18) Crown screw 118*a* is made of metallic material.
Crown washer 118*b* is made of metallic material.
19) Fixed inner hub 119 is made of metallic material.
20) Fixed outer hub 120 is made of metallic material.
21) Fixed-inner-hub plate 121 is made of metallic material.
22) Plate screws 122 each are made of metallic material.
23) Movable rib-hub system 123 is made of the combined materials of its components.
24) Movable inner hub 124 is made of metallic material.
25) Movable outer hub 125 is made of metallic material.
26) Movable tubular elevator 126 is made of metallic material.
27) Elevator screws 127 each are made of metallic material.
28) Arthritic-aiding tri-pulley system 128 is made of the combined materials of its components.
29) Two fixed-hub rotatable pulleys 129 each are made of metallic material.
30) Two fixed-hub-rotatable-pulley screws 130 each are made of metallic material.
31) Movable-hub rotatable pulley 131 is made of metallic material.
32) Movable-hub-rotatable-pulley screw 132 is made of metallic material.
33) Pulley cord 133 is made of nylon material.
34) Cord hook 134 is made of metallic material.
35) Anti-cable-fraying cable-locking gear-cam system 135 is made of the combined materials of its components.
36) Gear-cam mount 136 is made of metallic or plastic material.
37) Two gear-cam bearings 137 each are made of metallic material.
38) Two gear cams 138 each are made of plastic material.
39) Two gear-cam screws 139*a* each are made of metallic material.
Two gear-cam washers 139*b* each are made of metallic material.
40) Two L brackets 140 each are made of metallic material.
41) Hourglass-pulley 141 is made of metallic or plastic material.
42) Hourglass-pulley rivet 142 is made of metallic material.
43) Arthritic-aiding pin-centering pin-guiding auditorily-snap-locking tower-locking system 143 is made of the combined materials of its components.
44) Two umbrella-pole pin openings 144 each are made of empty space.
45) Arthritic-aiding cord-hook grip ring 145 is made of metallic material.
46) Anti-finger-pinching spacer 146 is made of metallic material.
47) Locking pin 147 is made of metallic material.
48) Auditorily-snap-locking recess 148 is made of metallic material.
49) Two pin-centering pin-guiding plugs 149 each are made of plastic material.
50) Two pin-centering pin-guiding tubes 150 each are made of plastic material.
51) Four auditorily-snap-locking leaf springs 151*a* each are made of plastic material.
Four auditorily-snap-locking nipples 151*b* each are made of plastic material.
52) Four internally-taperedly-threaded flexible towers 152 each are made of plastic material.
53) Twelve triangular tower leaf springs 153 each are made of plastic material.
54) Tower-locking screw 154 is made of metallic material.

Shape

Referring to FIGS. 3A, 3B, 3C, 3D, 4A, 4B, 4C, 4D, 5A, 5B, 5C, 6, 7A, 7B, 7C, 7D, and 7E:

1) Canopy and pole system 101, has the combined shapes of its components.
2) Canopy 102 has a circular shape.
3) Canopy openings 103 each have a circular shape.
4) Upper ribs 104 each have a tubular shape.
5) Upper-rib screws 105 each have a screw shape.
6) Lower ribs 106 each have a tubular shape.
7) Lower-rib screws 107 each have a screw shape.
8) Foldable rib joints 108 each have a triangular-sandwich shape, with one swollen side.
9) Umbrella pole 109 has a tubular shape.
10) Arthritic-aiding canopy-tension-adjusting system 110, has the combined shapes of its components.
11) Protracting-rod-locking screws 111*a* each have a screw shape.
Protracting-rod-locking washers 111*b* each have a circular shape.
12) Tension-adjusting oval rib openings 112 each have an oval shape.
13) Externally-threaded protracting rods 113 each have a tubular shape.
14) Threaded rod openings 114 each have a circular shape.
15) Internally-threaded tension-adjusting knobs 115 each have a circular shape.
16) Fixed rib-hub system 116, has the combined shapes of its components.
17) Internally-threaded crown 117 has a cylinder-cone shape.
18) Crown screw 118*a* has a screw shape.
Crown washer 118*b* has a circular shape.
19) Fixed inner hub 119 has a four-pointed-star shape.
20) Fixed outer hub 120 has a sixteen-pointed-star shape.
21) Fixed-inner-hub plate 121 has a wavy-circular shape.
22) Plate screws 122 each have a screw shape.
23) Movable rib-hub system 123, has the combined shapes of its components.
24) Movable inner hub 124 has a four-pointed-star shape.
25) Movable outer hub 125 has a sixteen-pointed-star shape.
26) Movable tubular elevator 126 has a cylinder-cone shape.
27) Elevator screws 127 each have a screw shape.
28) Arthritic-aiding tri-pulley system 128, has the combined shapes of its components.
29) Two fixed-hub rotatable pulleys 129 each have a pulley shape.

30) Two fixed-hub-rotatable-pulley screws 130 each have a screw shape.
31) Movable-hub rotatable pulley 131 has a pulley shape.
32) Movable-hub-rotatable-pulley screw 132 has a screw shape.
33) Pulley cord 133 has a rounded-cord shape.
34) Cord hook 134 has a hook shape.
35) Anti-cable-fraying cable-locking gear-cam system 135, has the combined shapes of its components.
36) Gear-cam mount 136 has a rectangular shape.
37) Two gear-cam bearings 137 each have a circular shape.
38) Two gear cams 138 each have a tear-dropped shape.
39) Two gear-cam screws 139*a* each have a screw shape.
Two gear-cam washers 139*b* each have a circular shape.
40) Two L brackets 140 each have an L-shaped shape.
41) Hourglass-pulley 141 has an hour-glass shape.
42) Hourglass-pulley rivet 142 has a circular shape.
43) Arthritic-aiding pin-centering pin-guiding auditorily-snap-locking tower-locking system 143, has the combined shapes of its components.
44) Two umbrella-pole pin openings 144 each have a circular shape.
45) Arthritic-aiding cord-hook grip ring 145 has an oval shape.
46) Anti-finger-pinching spacer 146 has a round shape.
47) Locking pin 147 has a round-tubular shape.
48) Auditorily-snap-locking recess 148 has a round-tubular shape.
49) Two pin-centering pin-guiding plugs 149 each have a round tubular shape.
50) Two pin-centering pin-guiding tubes 150 each have a round tubular shape.
51) Four auditorily-snap-locking leaf springs 151*a* each have a long-flat shape.
Four auditorily-snap-locking nipples 151*b* each have a round shape.
52) Four internally-taperedly-threaded flexible towers 152 each have an elongated-L-bracket shape.
53) Twelve triangular tower leaf springs 153 each have a triangular-flat shape.
54) Tower-locking screw 154 has a screw shape.

Connection

Referring to FIGS. 3A, 3B, 3C, 3D, 4A, 4B, 4C, 4D, 5A, 5B, 5C, 6, 7A, 7B, 7C, 7D, and 7E:

1) Canopy and pole system 101 has the combined connections of its components.
2) Canopy 102 is screwed on upper ribs 104.
3) Canopy openings 103 respectively are punched in canopy 102.
4) Upper ribs 104 respectively, are screwed to fixed outer hub 120.
5) Upper-rib screws 105 respectively are screwed to upper ribs 104 and fixed outer hub 120.
6) Lower ribs 106 respectively are screwed to movable outer hub 125.
7) Lower-rib screws 107 respectively are screwed to lower ribs 106 and movable outer hub 125.
8) Foldable rib joints 108 respectively are attached to upper ribs 104, and pivotably respectively are attached to lower ribs 106.
9) Umbrella pole 109 is attached to fixed-inner-hub plate 121.
10) Arthritic-aiding canopy-tension-adjusting system 110 has the combined connections of its components.
11) Protracting-rod-locking screws 111*a* respectively are screwed through protracting-rod-locking washers 111*b*, through canopy openings 103, through tension-adjusting oval rib openings 112, and into threaded rod openings 114. Protracting-rod-locking washers 111*b* respectively are slid on protracting-rod-locking screws 111*a*.
12) Tension-adjusting oval rib openings 112 respectively are drilled in upper ribs 104.
13) Externally-threaded protracting rods 113 respectively are inserted into the tips of upper ribs 104.
14) Threaded rod openings 114 respectively are drilled in externally-threaded protracting rods 113.
15) Internally-threaded tension-adjusting knobs 115 respectively are screwed on externally-threaded protracting rods 113.
16) Fixed rib-hub system 116 has the combined connections of its components.
17) Internally-threaded crown 117 is screwed to crown screw 118*a*.
18) Crown screw 118*a* is screwed to fixed inner hub 119.
19) Fixed inner hub 119 is molded to fixed outer hub 120.
20) Fixed outer hub 120 is molded to fixed inner hub 119.
21) Fixed-inner-hub plate 121 is welded on umbrella pole 109.
22) Plate screws 122 respectively are screwed through fixed-inner-hub plate, and on fixed inner hub 119.
23) Movable rib-hub system 123 has the combined connections of its components.
24) Movable inner hub 124 is slid on umbrella pole 109.
25) Movable outer hub 125 is molded to movable inner hub 124.
26) Movable tubular elevator 126 is screwed to movable inner hub 124.
27) Elevator screws 127 respectively are screwed on movable inner hub 124.
28) Arthritic-aiding tri-pulley system 128 has the combined connections of its components.
29) Two fixed-hub rotatable pulleys 129 respectively are screwed to fixed outer hub 120.
30) Two fixed-hub-rotatable-pulley screws 130 respectively are screwed on fixed outer hub 120.
31) Movable-hub rotatable pulley 131 is screwed to movable outer hub 125.
32) Movable-hub-rotatable-pulley screw 132 is screwed on movable outer hub 125.
33) Pulley cord 133 is threaded through the tri-pulley system, and is attached to movable outer hub 125.
34) Cord hook 134 is molded to arthritic-aiding cord-hook grip ring 145.
35) Anti-cable-fraying cable-locking gear-cam system 135 has the combined connections of its components.
36) Gear-cam mount 136 is screwed to movable tubular elevator 126.
37) Two gear-cam bearings 137 respectively are slid on gear-cam mount 136.
38) Two gear cams 138 respectively are slid on two gear-cam bearings 137.
39) Two gear-cam screws 139*a* respectively are inserted through two gear-cam washers 139*b*, and are screwed to gear-cam mount 136.
Two gear-cam washers 139*b* respectively are slid on two gear-cam screws 139*a*.
40) Two L brackets 140 respectively are screwed to gear-cam mount 136.
41) Hourglass-pulley 141 is rotatably riveted to two L brackets 140.

42) Hourglass-pulley rivet 142 is attached to two L brackets 140.

43) Arthritic-aiding pin-centering pin-guiding auditorily-snap-locking tower-locking system 143 has the combined connections of its components.

44) Two umbrella-pole pin openings 144 respectively are drilled through the two opposite walls of umbrella pole 109.

45) Arthritic-aiding cord-hook grip ring 145 is attached to locking pin 147.

46) Anti-finger-pinching spacer 146 is screwed on locking pin 147.

47) Locking pin 147 is molded to anti-finger-pinching spacer 146.

48) Auditorily-snap-locking recess 148 is molded in locking pin 147.

49) Two pin-centering pin-guiding plugs 149 respectively are molded to each other, and respectively are inserted into umbrella pole 109.

50) Two pin-centering pin-guiding tubes 150 respectively are molded in two pin-centering pin-guiding plugs 149, and respectively are aligned with two umbrella-pole pin openings 144.

51) Four auditorily-snap-locking leaf springs 151*a* respectively are molded on the opposite walls of two pin-centering pin-guiding tubes 150.

Four auditorily-snap-locking nipples 151*b* respectively are molded on four auditorily-snap-locking leaf springs 151*a*.

52) Four internally-taperedly-threaded flexible towers 152 respectively are molded to one of two pin-centering pin-guiding plugs 149.

53) Twelve triangular tower leaf springs 153 respectively are molded to four internally-taperedly-threaded flexible towers 152.

54) Tower-locking screw 154 is screwed between and on four internally-taperedly-threaded flexible towers 152.

Function

Referring to FIGS. 3A, 3B, 4C, 4D, 5B, 5C, 6, 7A, 7B, 8A, 8B, 8C, 8D, 9A, 9B, 9C, 9D, and 9E:

1) Canopy and pole system 101 is for performing the combined functions of its components.

2) Canopy 102 is for
Providing shade.

3) Canopy openings 103 respectively are for
Inserting Protracting-rod-locking screws 111*a* therethrough.

4) Upper ribs 104 respectively are for
Framingly bracing canopy 102.

5) Upper-rib screws 105 respectively are for
Securing upper ribs 104 to fixed outer hub 120.

6) Lower ribs 106 respectively are for
Pivotably bracing upper ribs 104.

7) Lower-rib screws 107 respectively are for
Securing lower ribs 106 to movable outer hub 125.

Figure 3A:
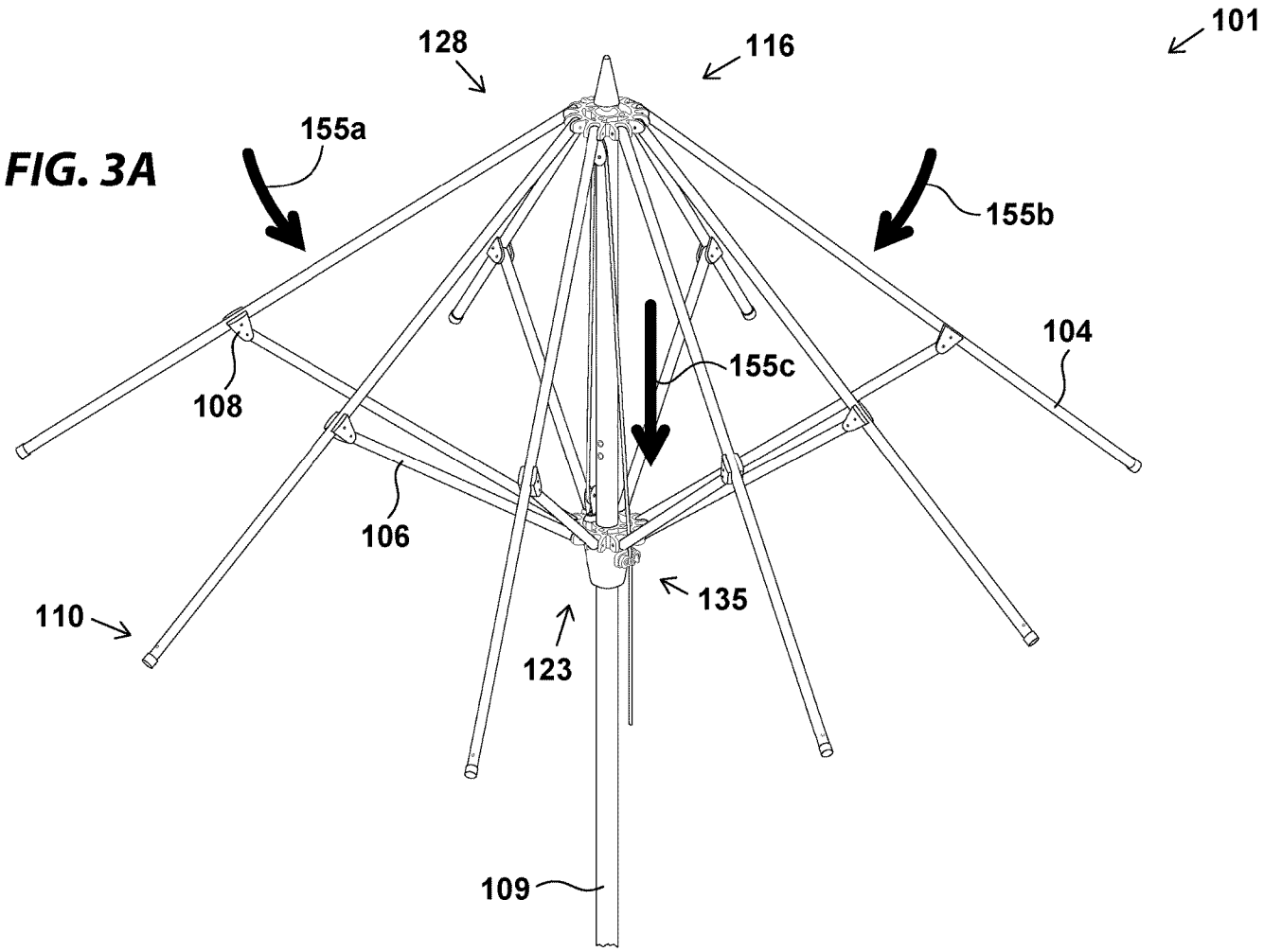
FIGS. 3A, 3B, 3C, and 3D illustrate perspective views of a unique canopy-tension-adjusting arthritic-aiding tri-pulley anti-cable-fraying pin-centering pin-guiding auditorily-snap-locking tower-locking umbrella system
Figure 3B:
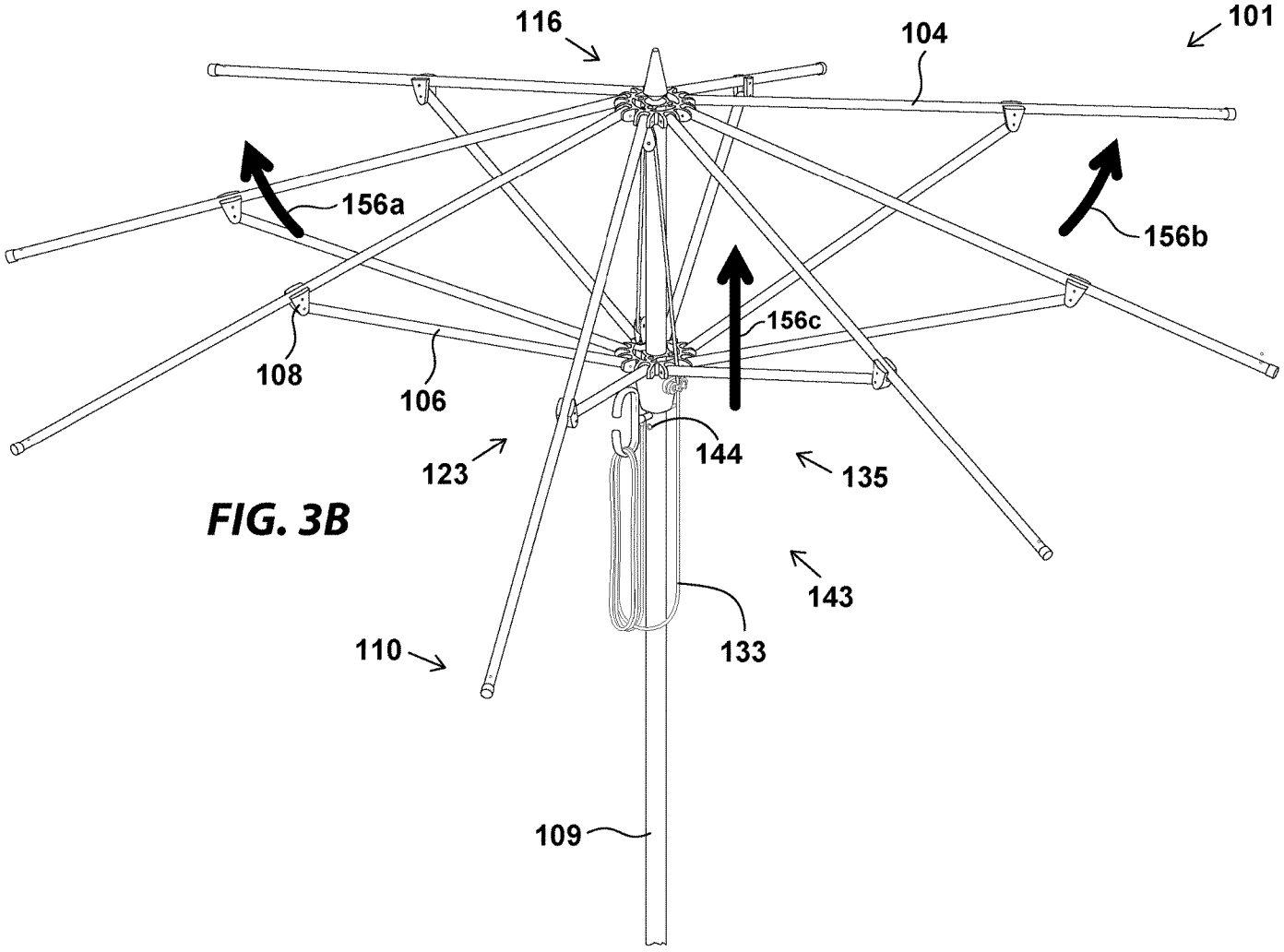
Figure 3C:
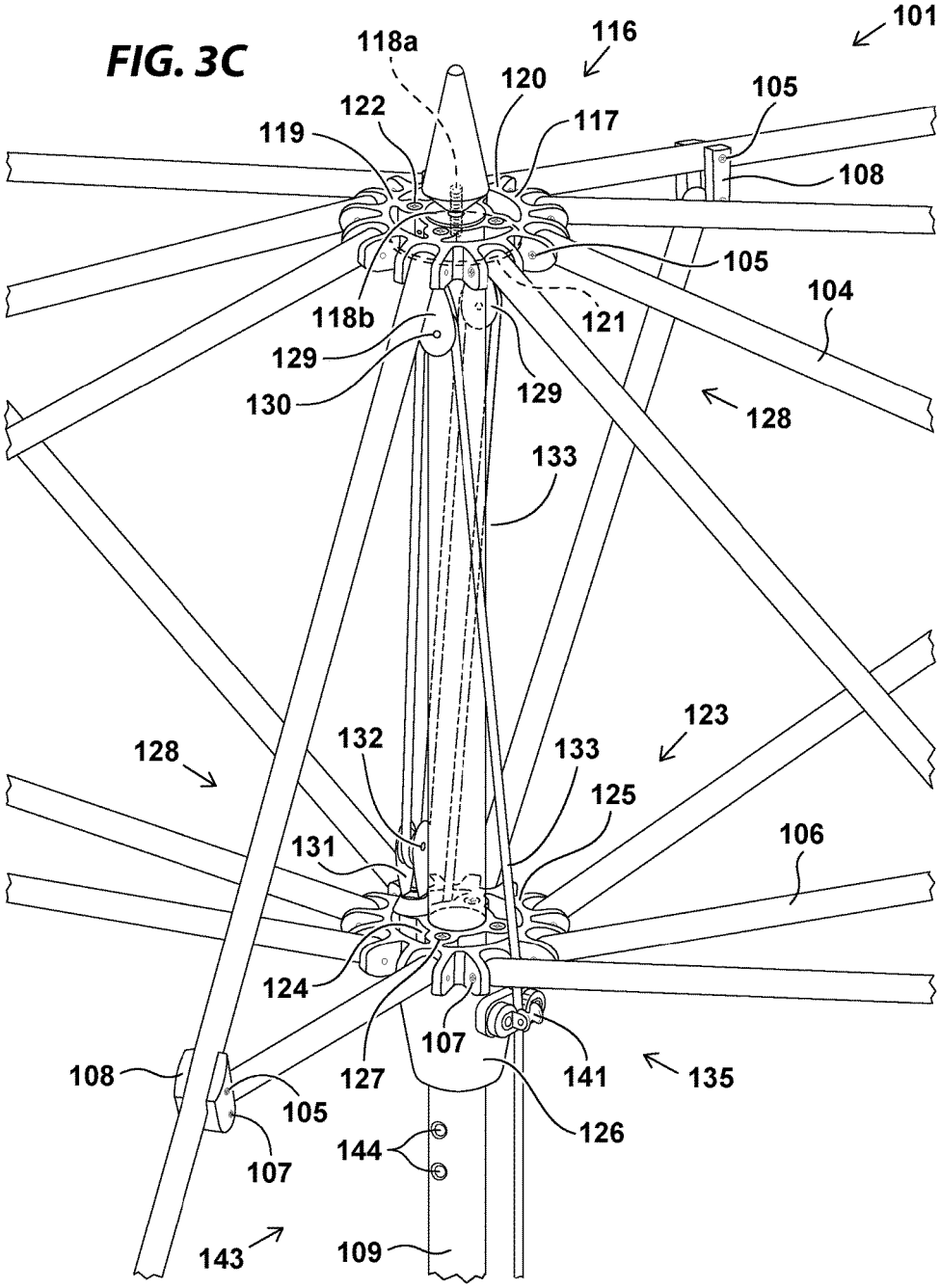

8) Foldable rib joints 108 respectively are for
Pivotably securing upper ribs 104 to lower ribs 106 to allow upper ribs 104 and lower ribs 106 to fold
in the directions of arrows 155*a*, 155*b*, and 155*c* (FIG. 3A), and
to deploy
in the directions of arrows 156*a*, 156*b*, and 156*c* (FIG. 3B).

9) Umbrella pole 109 is for
Supporting fixed rib-hub system 116 and movable rib-hub system 123.

10) Arthritic-aiding canopy-tension-adjusting system 110 is for performing the combined functions of its components.

11) Protracting-rod-locking screws 111*a* respectively are for
Threadedly securing canopy 102 to externally-threaded protracting rods 113.
Protracting-rod-locking washers 111*b* respectively are for
Protecting canopy 102 from protracting-rod-locking screws 111*a*.

12) Tension-adjusting oval rib openings 112 respectively are for
Providing adjustable-tension space to protracting-rod-locking screws 111*a*.

13) Externally-threaded protracting rods 113 respectively are for
Providing adjustable-tension capabilities to canopy 102-

14) Threaded rod openings 114 respectively are for
Threadedly securing externally-threaded protracting rods 113.

Figure 4A:
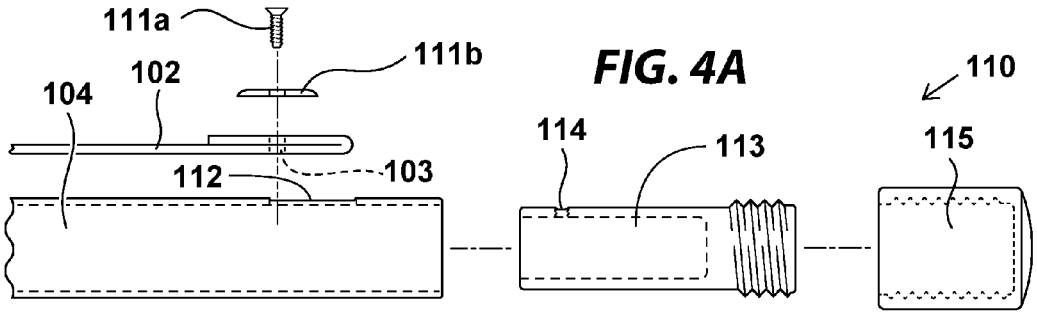
FIGS. 4A, 4B, 4C, and 4D illustrate side views of an arthritic-aiding canopy-tension-adjusting system.
Figure 4B:
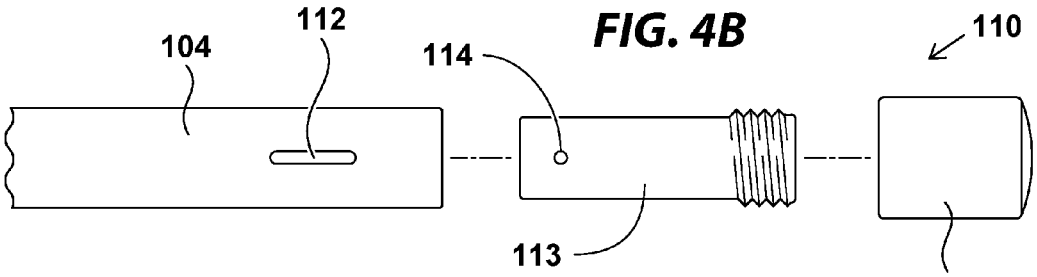
Figure 4C:
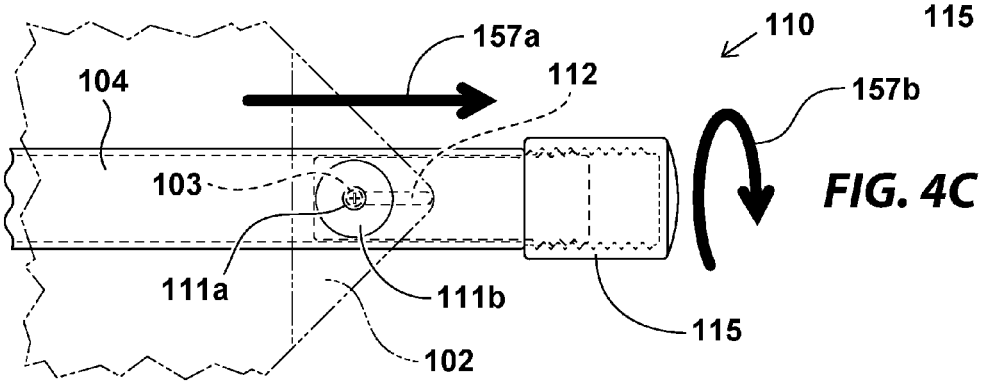
Figure 4D:
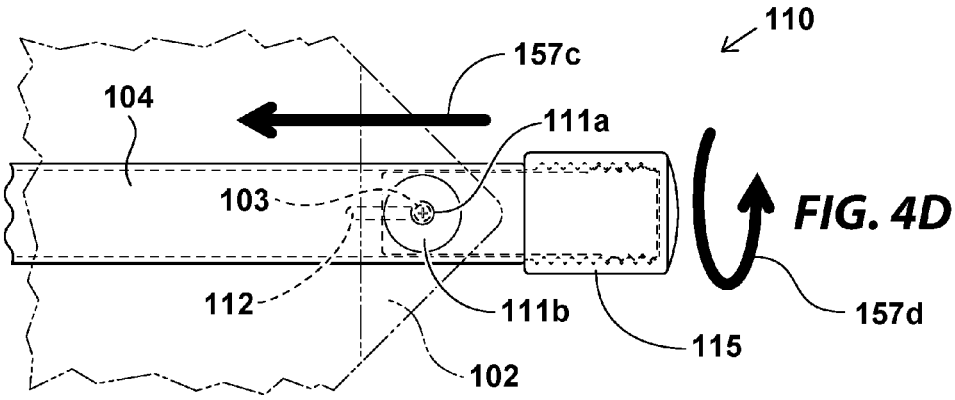
Figure 6:
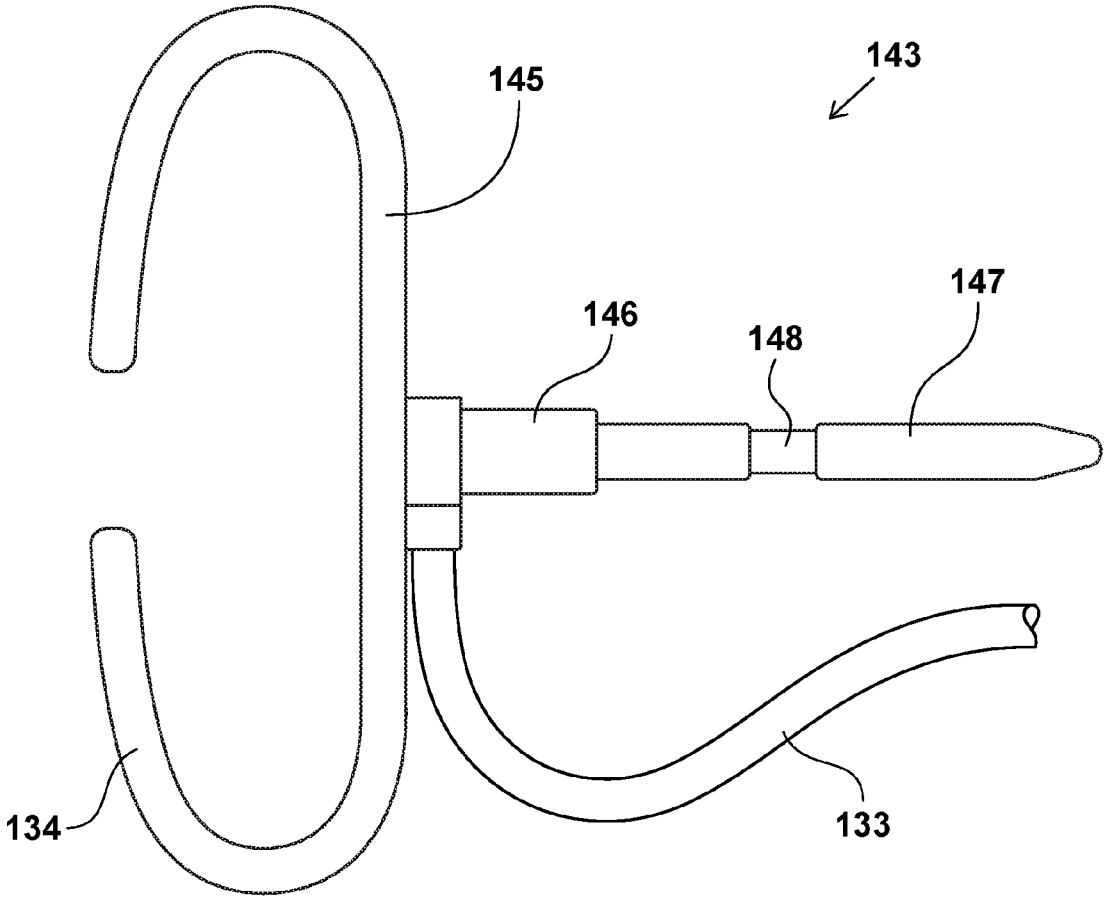
FIGS. 6, 7A, and 7B illustrate front views of an arthritic-aiding grip ring and how it is operated by a person with arthritic hands.
Figure 7A:
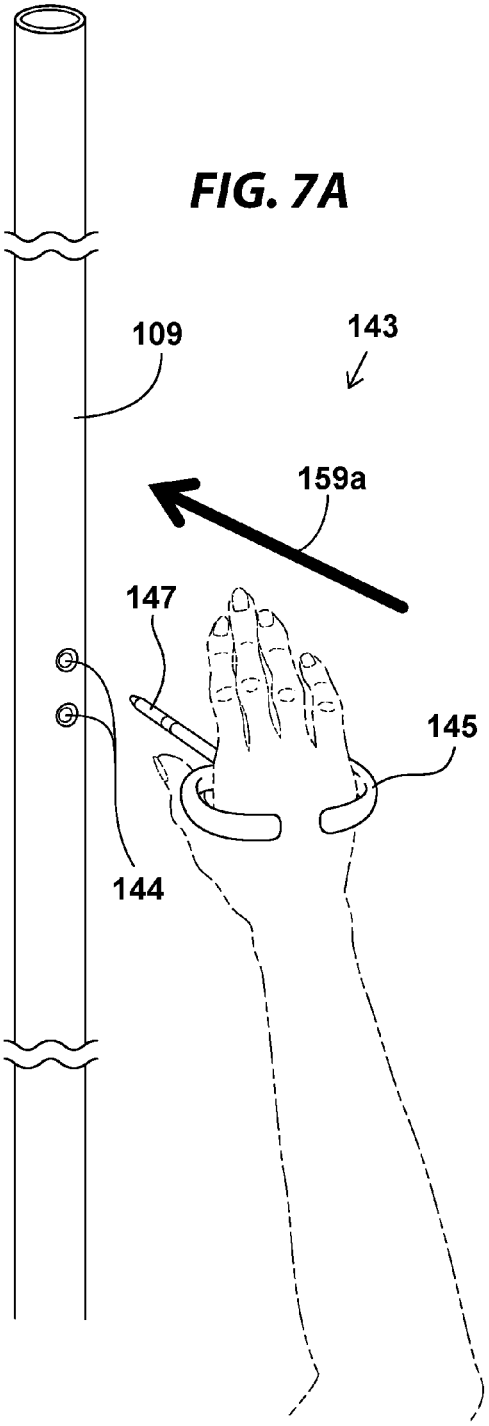
Figure 7B:
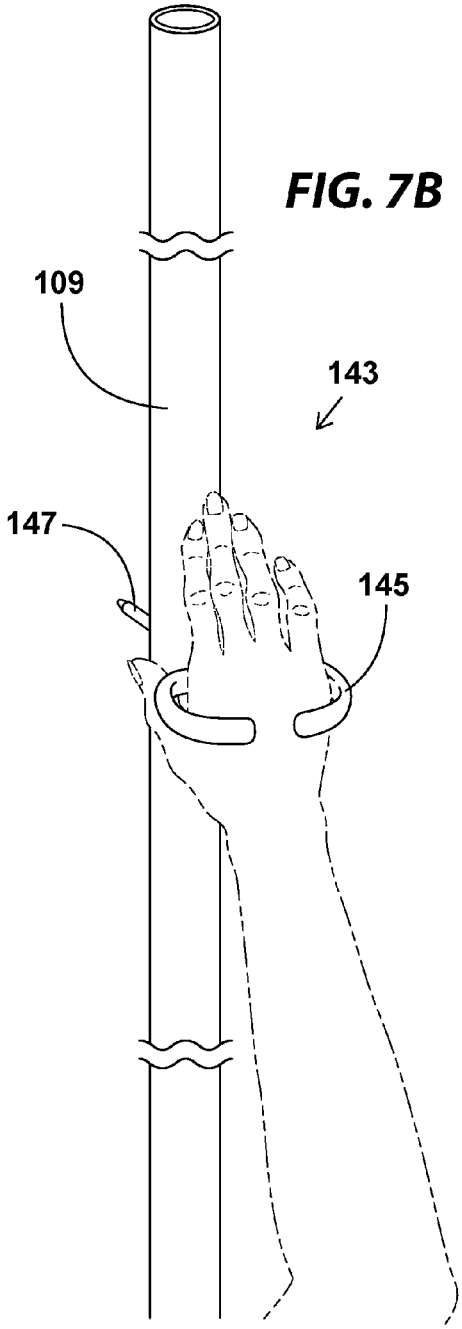

15) Internally-threaded tension-adjusting knobs 115 respectively are for
Adjustably securing externally-threaded protracting rods 113 to extend externally-threaded protracting rods 113 in the direction of arrow 157*a* when internally-threaded tension-adjusting knobs 115 is rotated in the direction of arrow 157*b* (FIG. 4C), and
to retract externally-threaded protracting rods 113 in the direction of arrow 157*c* when internally-threaded tension-adjusting knobs 115 is rotated in the direction of arrow 157*d* (FIG. 4D).

16) Fixed rib-hub system 116 is for performing the combined functions of its components.

17) Internally-threaded crown 117 is for
Being screwed on crown screw 118*a*.

18) Crown screw 118*a* is for
Being screwed on fixed inner hub 119.
Crown washer 118*b* is for
Being slid on crown screw 118*a*.

19) Fixed inner hub 119 is for
Securing fixed outer hub 120 to umbrella pole 109.

20) Fixed outer hub 120 is for
Pivotably securing upper ribs 104.

21) Fixed-inner-hub plate 121 is for
Securing fixed inner hub 119 to umbrella pole 109.

22) Plate screws 122 respectively are for
Securing fixed inner hub 119 to fixed-inner-hub plate 121.

23) Movable rib-hub system 123 is for performing the combined functions of its components.

24) Movable inner hub 124 is for
Slidably securing movable outer hub 125 to umbrella pole 109.

25) Movable outer hub 125 is for
Pivotably securing lower ribs 106.

26) Movable tubular elevator 126 is for
Providing a slidable handle to push up and pull down movable outer hub 125 to deploy and retract upper ribs 104 and lower ribs 106, respectively.

27) Elevator screws 127 respectively are for
Attaching movable inner hub 124 to movable tubular elevator 126.

28) Arthritic-aiding tri-pulley system 128 is for performing the combined functions of its components.

29) Two fixed-hub rotatable pulleys 129 respectively are for
Rotatably reducing the pulling force needed to hoist movable rib-hub system 123.

30) Two fixed-hub-rotatable-pulley screws 130 respectively are for

Securing two fixed-hub rotatable pulleys 129 to fixed inner hub 119.

31) Movable-hub rotatable pulley 131 is for
Rotatably reducing the pulling force needed to hoist movable rib-hub system 123.

32) Movable-hub-rotatable-pulley screw 132 is for
Securing movable-hub rotatable pulley 131 to movable inner hub 124.

33) Pulley cord 133 is for
Hoisting and lowering movable rib-hub system 123.

34) Cord hook 134 is for
Conveniently hooking and storing pulley cord 133 thereon.

35) Anti-cable-fraying cable-locking gear-cam system 135 is for performing the combined functions of its components.

36) Gear-cam mount 136 is for
Mounting two gear cams 138 on movable tubular elevator 126.

37) Two gear-cam bearings 137 respectively are for
Allowing two gear cams 138 to rotate easily.

38) Two gear cams 138 respectively are for
Centering pulley cord 133 to allow pulley cord 133 to move in the direction of arrow 158*a* (FIG. 5B), and
Clampingly securing pulley cord 133 therebetween, in the directions of arrows 158*b* and 158*c* (FIG. 5B).

39) Two gear-cam screws 139*a* respectively are for
Securing two gear-cam bearings 137 and two gear cams 138 to gear-cam mount 136.

40) Two L brackets 140 respectively are for
Securing hourglass-pulley rivet 142 to rear-cam mount 136.

41) Hourglass-pulley 141 is for
Allowing pulley cord 133 to move up and down, friction-free in the opposite directions of arrow 158*d* (FIG. 5C),
Eliminate the problems of pulley cord 133 fraying and breaking from rubbing against two L brackets 140,
Centering pulley cord 133, and
Prevent pulley cord 133 from going astray.

42) Hourglass-pulley rivet 142 is for
Rotatably securing hourglass-pulley 141 to two L brackets 140.

43) Arthritic-aiding pin-centering pin-guiding auditorily-snap-locking tower-locking system 143 is for performing the combined functions of its components.

44) Two umbrella-pole pin openings 144 respectively are for
Inserting locking pin 147 therethrough.

Figure 3D:
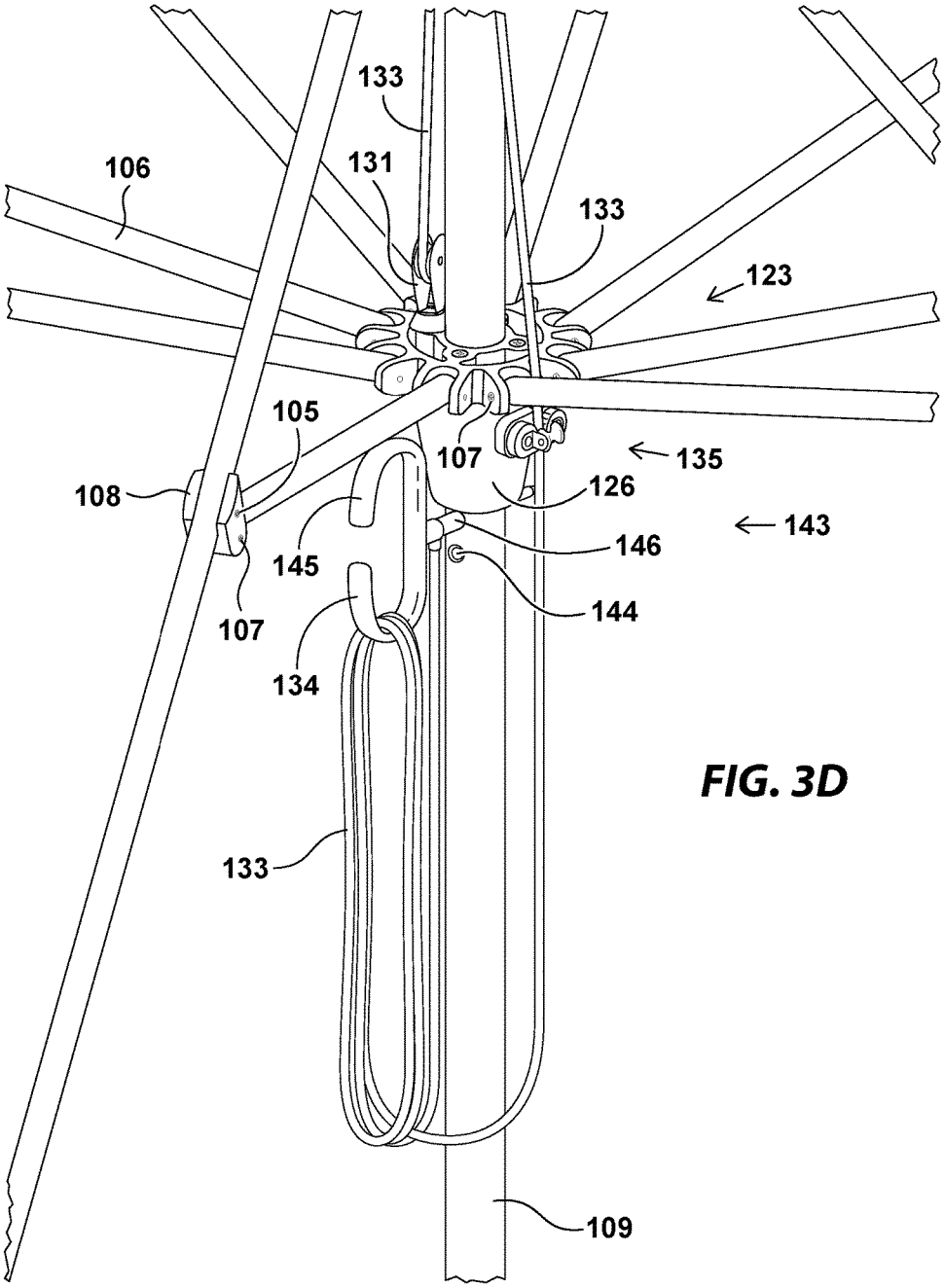

45) Arthritic-aiding cord-hook grip ring 145 is for
Medicinally beneficially allowing a user with an arthritic hand to keep his/her hand straight (to eliminate the needs for bending his/her fingers and wrist) when holding and operating arthritic-aiding cord-hook grip ring 145 by inserting his/her hand through arthritic-aiding cord-hook grip ring 145 and inserting locking pin 147 into one of
two pin-centering pin-guiding tubes 150 in the direction of arrow 159*a* (FIGS. 6, 7A, and 7B); and
Conveniently hooking and storing pulley cord 133 thereon (FIG. 3D).

46) Anti-finger-pinching spacer 146 is for
Safely keeping a hand from a user away from two umbrella-pole pin openings 144 to prevent the hand's skin from being pinched by locking pin 147.

Figure 8A:
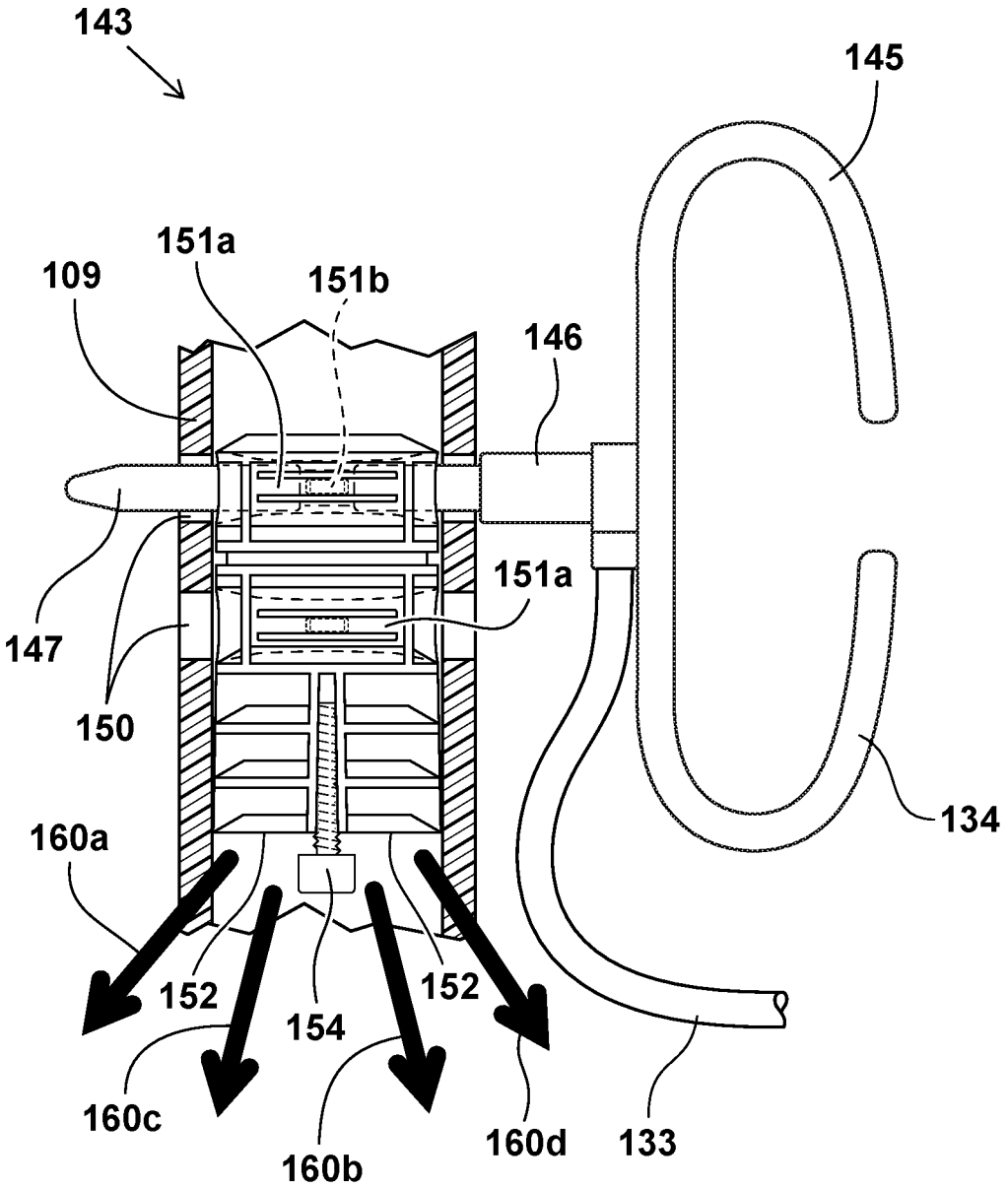
FIGS. 8A, 8B, 8C, and 8D illustrate rear views of how an arthritic-aiding pin-centering pin-guiding auditorily-snap-locking tower-locking system work with two pin-centering pin-guiding tubes, four auditorily-snap-locking leaf springs, and four auditorily-snap-locking nipples.

47) Locking pin 147 is for
Locking movable rib-hub system 123 at one of two desired elevations of two umbrella-pole pin openings 144, respectively when being inserted into one of two pin-centering pin-guiding tubes 150
in the direction of arrow 159*a* (FIGS. 8A, 8B, and 8C)
to push two of four auditorily-snap-locking leaf springs 151*a* outward
in the opposite directions of arrows 159*b* and 159*c* (FIGS. 8A, 8B, and 8C), and
until two of four auditorily-snap-locking nipples 151*b* auditorily snap-lock in auditorily-snap-locking recess 148
in the opposite directions of arrows 159*d* and 159*e* (FIG. 8D)
to generate snap-locking sounds 159*f* and 159*g* (FIG. 8D) and
to lock locking pin 147 in one of two pin-centering pin-guiding tubes 150 (FIG. 8A).

48) Auditorily-snap-locking recess 148 is for
Locking two of four auditorily-snap-locking nipples 15 therein, and
Auditorily alerting that two of four auditorily-snap-locking nipples 15 are locked therein.

49) Two pin-centering pin-guiding plugs 149 respectively are for
Centering and aligning two pin-centering pin-guiding tubes 150 with two umbrella-pole pin openings 144 inside umbrella pole 109.

50) Two pin-centering pin-guiding tubes 150 respectively are for
Accurately and conveniently guiding locking pin 147 from one of two umbrella-pole pin openings 144 to another of two umbrella-pole pin openings 144.

Figure 8B:
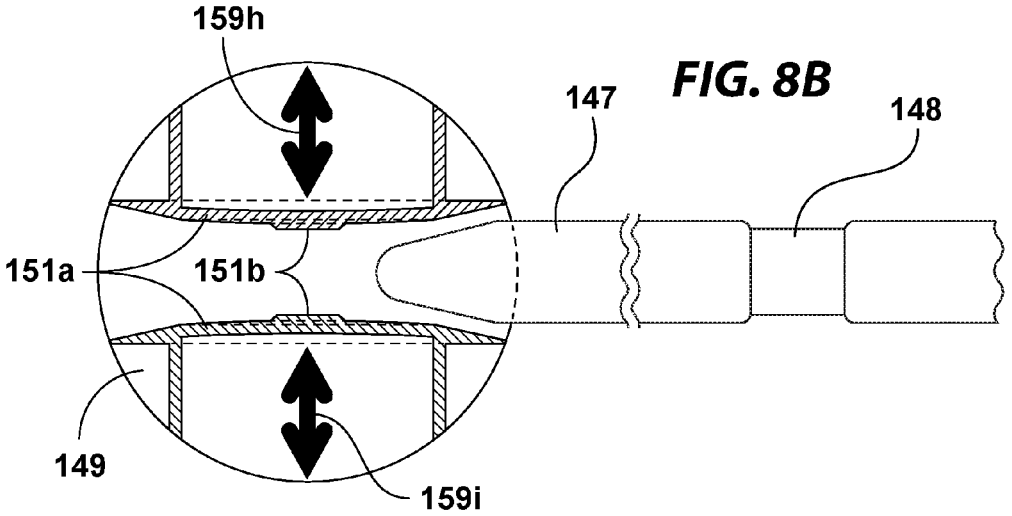
Figure 8C:
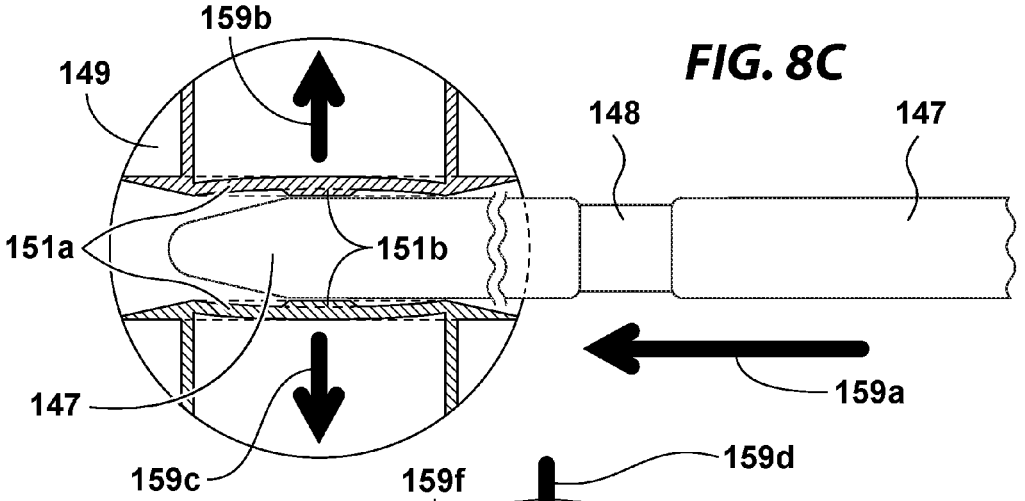
Figure 8D:
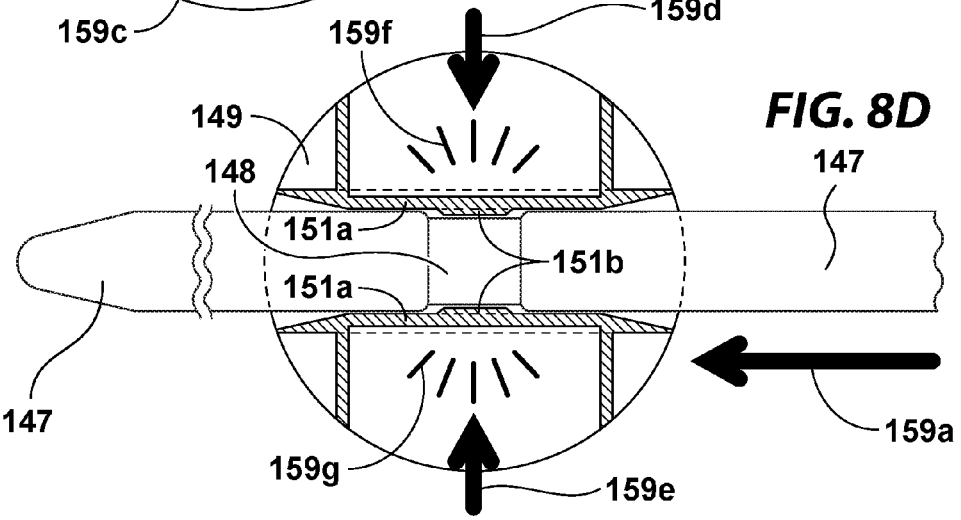
Figure 9A:
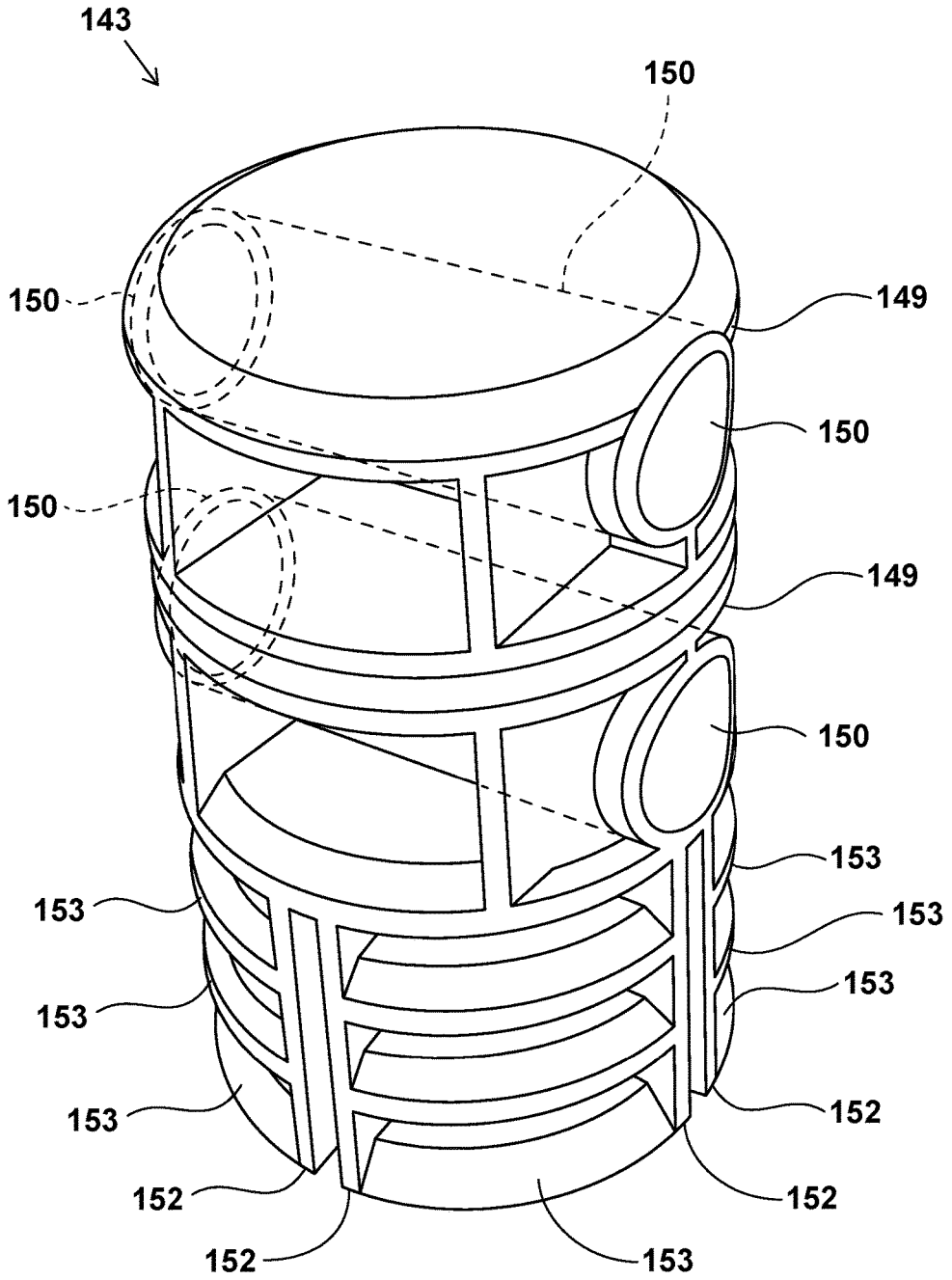
FIGS. 9A, 9B, 9C, 9D, and 9E illustrate perspective, front, and bottom views of two pin-centering pin-guiding plugs, two pin-centering pin-guiding tubes, four auditorily-snap-locking leaf springs, four auditorily-snap-locking nipples, four internally-taperedly-threaded flexible towers, and twelve triangular tower leaf springs.
Figure 9B:
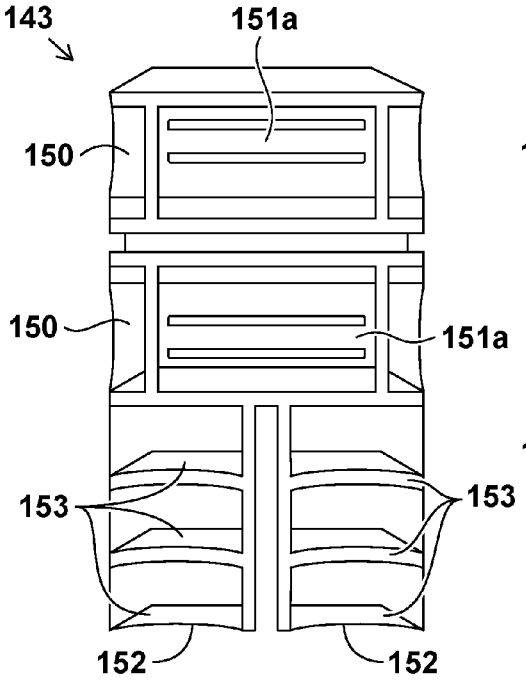
Figure 9C:
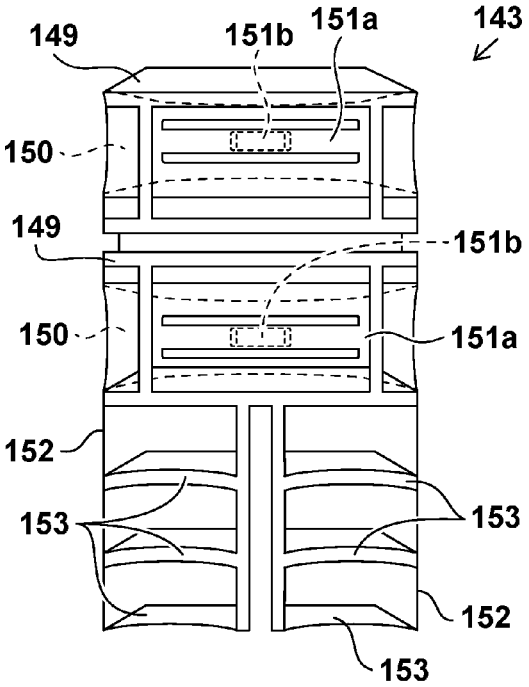
Figure 9D:
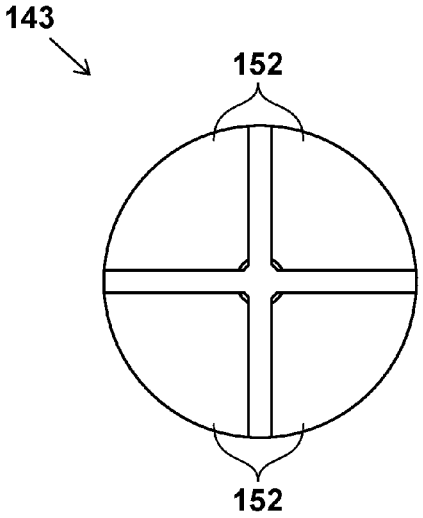
Figure 9E:
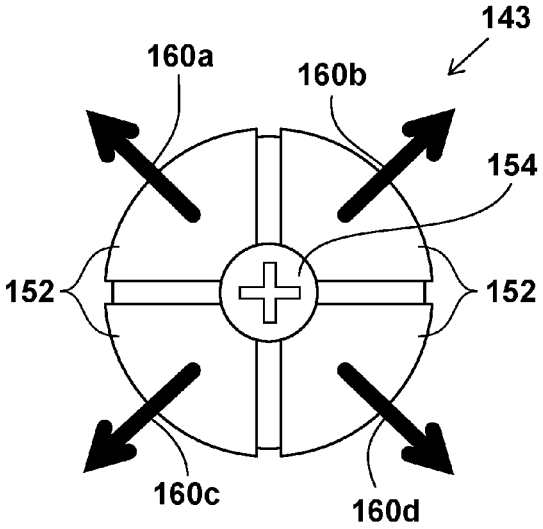

51) Four auditorily-snap-locking leaf springs 151*a* respectively are for
Springably pushing and auditorily snap-locking four auditorily-snap-locking nipples 151*b* inside auditorily-snap-locking recess 148, respectively,
in the opposite directions of arrows 159*h* and 159*i* (FIG. 8B).
Four auditorily-snap-locking nipples 151*b* respectively are for
Auditorily snap-locking locking pin 147 inside auditorily-snap-locking recess 148.

52) Four internally-taperedly-threaded flexible towers 152 respectively are for
Springably being pushed outwardly by tower-locking screw 154 to releasably secure two pin-centering pin-guiding plugs 149, two pin-centering pin-guiding tubes 150, four auditorily-snap-locking leaf springs 151*a*, four auditorily-snap-locking nipples 151*b*, four internally-taperedly-threaded flexible towers 152, and twelve triangular tower leaf springs 153 inside umbrella pole 109 at a desire elevation.

53) Twelve triangular tower leaf springs 153 respectively are for
Springably pushing four internally-taperedly-threaded flexible towers 152 toward the central axis therebetween when four internally-taperedly-threaded flexible towers 152 are pushed outward by tower-locking screw 154
in four directions of arrows 160*a*, 160*b*, 160*c*, and 160*d* (FIGS. 9A, 9B, 9C, 9D, and 9E).

54) Tower-locking screw 154 is for
Threadedly pushing four internally-taperedly-threaded flexible towers 152 outward
to releasably secure two pin-centering pin-guiding plugs 149, two pin-centering pin-guiding tubes 150, four auditorily-snap-locking leaf springs 151*a*, four auditorily-snap-locking nipples 151*b,* four internally-taperedly-threaded flexible towers 152, and twelve triangular tower leaf springs 153 inside umbrella pole 109 at a desire elevation.

Variation

Figure 13:
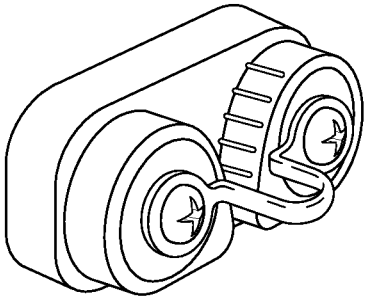
FIG. 13 illustrates a perspective view of variations of two L brackets, an hourglass-pulley, and an hourglass-pulley rivet.
Figure 14:
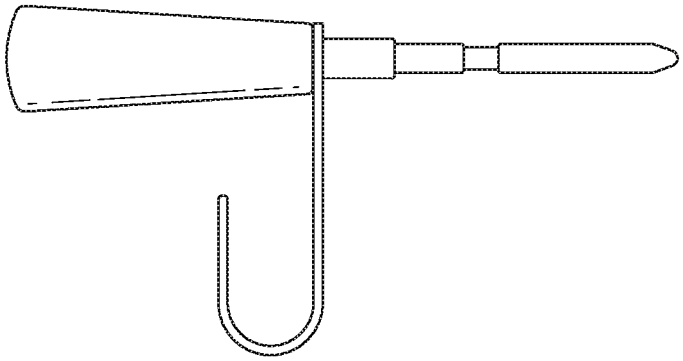
FIG. 14 illustrates a front view of variations of an arthritic-aiding grip ring, an anti-finger-pinching spacer, a locking pin, and an auditorily-snap-locking recess.

Any component of the unique canopy-tension-adjusting arthritic-aiding tri-pulley anti-cable-fraying pin-centering pin-guiding auditorily-snap-locking tower-locking umbrella system can have any shape and size. Any component of the unique canopy-tension-adjusting arthritic-aiding tri-pulley anti-cable-fraying pin-centering pin-guiding auditorily-snap-locking tower-locking umbrella system can be made of any material or any combination of any materials. Any component of the unique canopy-tension-adjusting arthritic-aiding tri-pulley anti-cable-fraying pin-centering pin-guiding auditorily-snap-locking tower-locking umbrella system can be made of any flexible, semi-flexible, bendable, semi-bendable, rigid, or semi-rigid material(s). For example, tower-locking screw 154 can be Philip screw, allen screw, etc. For example, FIG. 10 illustrates a side view of an equivalent variation of the arthritic-aiding canopy-tension-adjusting system. For another example, FIGS. 11 and 12 illustrate front views of equivalent variations of four auditorily-snap-locking leaf springs, four auditorily-snap-locking nipples, and twelve triangular tower leaf springs. For another example, FIG. 13 illustrates a perspective view of equivalent variations of two L brackets, an hourglass-pulley, and an hourglass-pulley rivet. For another example, FIG. 14 illustrates a front view of equivalent variations of an arthritic-aiding grip ring, an anti-finger-pinching spacer, a locking pin, and an auditorily-snap-locking recess.

MAJOR ADVANTAGES OF THE INVENTION

The present invention substantially departs from the conventional concepts and designs of the prior art. In doing so, the present invention provides a unique canopy-tension-adjusting arthritic-aiding tri-pulley anti-cable-fraying pin-centering pin-guiding auditorily-snap-locking tower-locking umbrella system (having: a) Canopy and pole system, b) Arthritic-aiding canopy-tension-adjusting system, c) Fixed rib-hub system, d) Movable rib-hub system, e) Arthritic-aiding tri-pulley system, f) Anti-cable-fraying cable-locking gear-cam system g) Arthritic-aiding pin-centering pin-guiding auditorily-snap-locking tower-locking system) having many unique and significant features, functions, and advantages, which overcome all the disadvantages of the prior art, as follows:

1) It is still another object of the new invention to provide a unique canopy-tension-adjusting arthritic-aiding tri-pulley anti-cable-fraying pin-centering pin-guiding auditorily-snap-locking tower-locking umbrella system,
   having an arthritic-aiding cord-hook grip ring and an anti-finger-pinching spacer.
   Therefore, the unique canopy-tension-adjusting arthritic-aiding tri-pulley anti-cable-fraying pin-centering pin-guiding auditorily-snap-locking tower-locking umbrella system:
   a) Can encircle the broad surface of the metacarpals of the palm of the hand or the broad surface of the union of the metacarpals with the base of the phalanges,
      to provide an enlarged surface area to engage with the palm of an open hand to insert a locking pin, providing greater comfort and availability to an arthritic suffering person (FIGS. 6, 7A, 7B and 8A);
   b) Can encircle the broad surface of the metacarpals of the back of the hand or the broad surface of the union of the metacarpals with the base of the phalanges,
      to provide an enlarged surface area; to engage with the back of an open hand; to extract a locking pin, providing greater comfort and availability to an arthritic suffering person (FIGS. 6, 7A, 7B and 8A);
   c) Can allow a user with an arthritic hand to keep his/her hand straight,
      to eliminate the needs to bend ones' fingers and wrist when holding and operating arthritic-aiding cord-hook grip ring (FIGS. 6, 7A, and 7B); and
   d) Can allow a user with an arthritic hand to keep his/her hand straight,
      to render access to the interior of the hook section, for conveniently storing a coiled excess portion of a pulley cord (FIGS. 3D, 6, 7A, 7B and 8A).

2) It is a further object of the new invention to provide a unique canopy-tension-adjusting arthritic-aiding tri-pulley anti-cable-fraying pin-centering pin-guiding auditorily-snap-locking tower-locking umbrella system,
   having four auditorily-snap-locking leaf springs, four auditorily-snap-locking nipples, and an auditorily-snap-locking recess.
   Therefore, the unique canopy-tension-adjusting arthritic-aiding tri-pulley anti-cable-fraying pin-centering pin-guiding auditorily-snap-locking tower-locking umbrella system:
   a) Can emit a snapping sound loud enough
      to allow a person to hear the sound and recognize the moment that a locking pin is fully engaged (FIGS. 8A, 8B, 8C, and 8D);
   b) Can transmit a vibration-emitting movement, projected by an interaction between two of four auditorily-snap-locking nipples,
      to allow a person, utilizing their tactile senses, to recognize the moment a locking pin has fully engaged (FIGS. 8A, 8B, 8C, and 8D);
   c) Can lock with one action,
      to eliminate the need to secondarily insert a cotter key, or split-wire ring, to secure pin in vertical post (FIGS. 7A, 7B, 8A, 8B, 8C, and 8D); and
   d) Can easily and instantly be inserted and extracted with minimal effort,
      to eliminate pain experienced by an arthritic person (FIGS. 7A, 7B, 8A, 8B, 8C, and 8D).

3) It is an even further object of the new invention to provide a unique canopy-tension-adjusting arthritic-aiding tri-pulley anti-cable-fraying pin-centering pin-guiding auditorily-snap-locking tower-locking umbrella system,
   having an arthritic-aiding canopy-tension-adjusting system.
   Therefore, the unique canopy-tension-adjusting arthritic-aiding tri-pulley anti-cable-fraying pin-centering pin-guiding auditorily-snap-locking tower-locking umbrella system:
   a) Can easily adjust,
      to compensate for conditions resulting in canopy fabric being too small or too tight (FIGS. 4A, 4B, 4C, and 4D);
   b) Can easily adjust,
      to compensate for conditions which loosen the canopy fabric causing sagging (FIGS. 4A, 4B, 4C, and 4D); and c) Can provide internally-threaded tension-adjusting knobs whose flat surface can be easily rotated open-handed, by an arthritic hand
to eliminate the need to curl fingers to rotate, causing pain to an arthritic suffering person (FIGS. 4A, 4B, 4C, and 4D).

4) It is still another object of the new invention to provide a unique canopy-tension-adjusting arthritic-aiding tri-pulley anti-cable-fraying pin-centering pin-guiding auditorily-snap-locking tower-locking umbrella system,
having two pin-centering pin-guiding tubes.
Therefore, the unique canopy-tension-adjusting arthritic-aiding tri-pulley anti-cable-fraying pin-centering pin-guiding auditorily-snap-locking tower-locking umbrella system:
a) Can provide two tapered cone-shaped receiving apertures, on opposing ends, acting as a funnel while an arthritic suffering person inserts a locking pin,
to aid shaky arthritic hand to easily locate the tip of a locking pin to the inwardly tapered cone-shaped receiving apertures (FIGS. 7A, 7B, 8A, 8B, 8C, and 8D);
b) Can provide a conduit between two umbrella-pole pin openings,
to eliminate difficulty lining up common pin holes on either side for an arthritic hand (FIGS. 7A, 7B, 8A, 8B, 8C, and 8D);
c) Can provide a very low-friction material and low-friction internal surface,
to aid a shaky arthritic hand to effortlessly slide a locking pin into and through the two pin-centering pin-guiding tubes (FIGS. 7A, 7B, 8A, 8B, 8C, and 8D); and
d) Can provide two inwardly tapered cone-shaped receiving apertures, on opposing ends,
to provide greater access to, and increase comfort for a painful arthritic hand (FIGS. 7A, 7B, 8A, 8B, 8C, and 8D).

5) It is yet another object of the new invention to provide a unique canopy-tension-adjusting arthritic-aiding tri-pulley anti-cable-fraying pin-centering pin-guiding auditorily-snap-locking tower-locking umbrella system,
having four internally-taperedly-threaded flexible towers.
Therefore, the unique canopy-tension-adjusting arthritic-aiding tri-pulley anti-cable-fraying pin-centering pin-guiding auditorily-snap-locking tower-locking umbrella system:
a) Can simply be inserted from the top or bottom of an umbrella pole,
to overcome the need to have special tooling and reduce costs, materials, and labor (FIGS. 9A, 9B, 9C, 9D and 9E);
b) Can secure within an umbrella pole, by the turn of a tower-locking screw,
to lock them in position, using a simple method, designed to reduce costs, materials, and labor (FIGS. 9A, 9B, 9C, 9D and 9E);
c) Can provide a cost-saving manufacturing method by being molded into a one-piece unit,
to reduce manufacturing costs and conserve molding materials (FIGS. 9A, 9B, 9C, 9D and 9E); and
d) Can provide a cost-saving manufacturing method by being molded into a one-piece unit,
to reduce labor during assembly (FIGS. 9A, 9B, 9C, 9D and 9E).

6) It is still yet another object of the new invention to provide a unique canopy-tension-adjusting arthritic-aiding tri-pulley anti-cable-fraying pin-centering pin-guiding auditorily-snap-locking tower-locking umbrella system,
having twelve triangular tower leaf springs.
Therefore, the unique canopy-tension-adjusting arthritic-aiding tri-pulley anti-cable-fraying pin-centering pin-guiding auditorily-snap-locking tower-locking umbrella system:
a) Can create a low-pressure friction fit within an umbrella pole, with respectively evenly-distributed pressure around the perimeter,
to securely position the arthritic-aiding pin-centering pin-guiding auditorily-snap-locking tower-locking system with minimal pressure being exerted against the internal structure of an umbrella pole (FIGS. 9A, 9B, 9C, 9D and 9E);
b) Can create a low-pressure friction fit within an umbrella pole,
to prevent over-tightening of the four internally-taperedly-threaded flexible towers during assembly (FIGS. 9A, 9B, 9C, 9D and 9E);
c) Can provide a cost-saving manufacturing technique,
to reduce manufacturing costs and conserve molding materials (FIGS. 9A, 9B, 9C, 9D and 9E); and
d) Can provide arched leaf springs, creating an evenly-distributed-pressure friction fit within an umbrella pole,
to exert adequate outward pressure, without exerting excessive pressure, and self-adjust as needed in response to environmental conditions (FIGS. 9A, 9B, 9C, 9D and 9E).

7) It is an object of the new invention to provide a unique canopy-tension-adjusting arthritic-aiding tri-pulley anti-cable-fraying pin-centering pin-guiding auditorily-snap-locking tower-locking umbrella system,
having an anti-cable-fraying cable-locking gear-cam system.
Therefore, the unique canopy-tension-adjusting arthritic-aiding tri-pulley anti-cable-fraying pin-centering pin-guiding auditorily-snap-locking tower-locking umbrella system:
a) Can overcome common impediments of prior art,
to allow an arthritic sufferer to utilize the umbrella system (FIG. 1 Prior Art);
b) Can overcome the need required by prior art, to curl thumb and fingers of a single hand around a pole to engage the locking pin,
to insert or compress a spring activated pin, or a manually inserted pin, into vertical umbrella center pole pin hole (FIG. 1 Prior Art);
c) Can allow opposing pressure from between thumb and fingers of a single hand around a pole to engage the locking pin,
to insert or compress a spring activated pin, or a manually inserted pin, into vertical umbrella center pole pin hole (FIG. 1 Prior Art); and
d) Can allow opposing pressure from another hand, such as an opposing left hand or an opposing right hand,
to insert or compress a spring activated pin, or a manually inserted pin, into vertical umbrella center pole pin hole (FIG. 1 Prior Art).

8) It is another object of the new invention to provide a unique canopy-tension-adjusting arthritic-aiding tri-pulley anti-cable-fraying pin-centering pin-guiding auditorily-snap-locking tower-locking umbrella system, having an anti-cable-fraying cable-locking gear-cam system.

Figure 2:
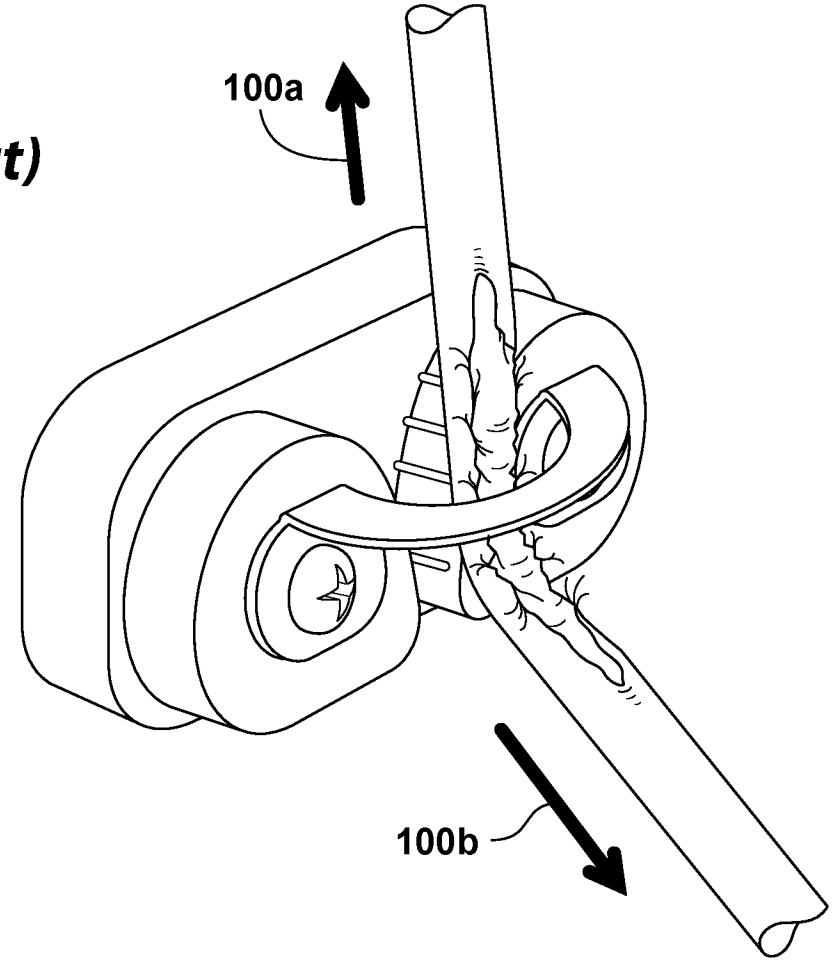
FIG. 2 (Prior Art)
FIG. 2 (Prior Art) illustrates a perspective view of the problems caused by prior-art umbrella-cord-locking cams, which cut and make an umbrella cord fray.

Therefore, the unique canopy-tension-adjusting arthritic-aiding tri-pulley anti-cable-fraying pin-centering pin-guiding auditorily-snap-locking tower-locking umbrella system:

a) Can provide a greater surface area in contact with a pulley cord,
to reduce concentrated friction encountered by their interaction, resulting in less wear and increased useable material life (FIGS. 2 Prior Art, 5A, 5B, and 5C);

b) Can provide a smoother surface area in contact with a pulley cord,
to reduce concentrated friction encountered by their interaction, resulting in less wear and increased useable material life (FIGS. 2 Prior Art, 5A, 5B, and 5C);

c) Can provide a rolling surface area in contact with a pulley cord,
to reduce concentrated friction encountered by their interaction, resulting in less wear and increased useable material life (FIGS. 2 Prior Art, 5A, 5B, and 5C);

d) Can provide a rolling surface area in contact with a pulley cord,
to simplify the pulling effort required by the hands of an arthritic suffering person (FIGS. 2 Prior Art, 5A, 5B, and 5C); and e) Can provide an hourglass-shaped rolling surface area in contact with a pulley cord,
to allow a pulley cord to glide along its surface, while being pulled or released at a large range of different angles (FIGS. 2 Prior Art, 5A, 5B, and 5C).

What is claimed is:

1. An arthritic-aiding pin-guiding auditorily-snap-locking umbrella comprising:

a canopy and pole system comprising:
a canopy, said canopy having a plurality of canopy openings,
a plurality of upper ribs, each of said upper ribs having a rib tip,
a plurality of lower ribs,
a plurality of foldable rib joints respectively attached to said upper ribs and pivotably attached to said lower ribs,
an umbrella pole, said umbrella pole having a pole top,
a fixed inner hub attached to said pole top,
a fixed outer hub molded to said fixed inner hub and pivotably screwed to said upper ribs,
a movable inner hub movably slid on said umbrella pole,
a movable outer hub molded to said movable inner hub and pivotably screwed to said lower ribs, and
a movable tubular elevator screwed to said movable inner hub;

a canopy-tension-adjusting system comprising:
a plurality of protracting-rod-locking washers,
a plurality of tension-adjusting oval rib openings respectively drilled in said upper ribs,
a plurality of externally-threaded protracting rods respectively inserted into said rib tip of said upper ribs,
a plurality of threaded rod openings respectively drilled in said externally-threaded protracting rods,
a plurality of internally-threaded tension-adjusting knobs respectively screwed on said externally-threaded protracting rods, and
a plurality of protracting-rod-locking screws respectively screwed through said protracting-rod-locking washers, through said canopy openings, through said tension-adjusting oval rib openings, and into said threaded rod openings
for tensioning said canopy;

an arthritic-aiding tri-pulley system comprising:
two fixed-hub pulleys respectively screwed to said fixed outer hub,
a movable-hub pulley screwed to said movable outer hub,
a pulley cord threaded on said two fixed-hub pulleys and said movable-hub pulley, and attached to said movable outer hub, and
a cord hook
for said pulley cord to be releasably hooked thereon;

an anti-cable-fraying cable-locking gear-cam system comprising:
a gear-cam mount screwed to said movable tubular elevator,
two gear cams each having a tear-dropped shape
for clampingly securing said pulley cord therebetween and allowing said pulley cord to move in only one direction therebetween,
a cord blocker, and
two gear-cam screws respectively screwed through said cord blocker, through said two gear cams, and onto said gear-cam mount; and an arthritic-aiding pin-centering-and-guiding auditorily-snap-locking tower-locking system comprising:
at least one pin opening respectively drilled through said umbrella pole,
an arthritic-aiding grip ring attached to said cord hook for aiding an arthritic use,
an anti-finger-pinching spacer screwed on said cord hook,
a locking pin molded to said anti-finger-pinching spacer,
an auditorily-snap-locking recess molded on said locking pin,
at least one pin-centering-and-guiding plug inserted into said umbrella pole,
at least one pin-centering-and-guiding tube molded inside said at least one pin-centering-and-guiding plug and aligned with said at least one pin opening
for centering said locking pin inside said at least one pin-centering-and-guiding tube and
for guiding said locking pin through said at least one pin opening,
a plurality of auditorily-snap-locking leaf springs molded inside said at least one pin-centering-and-guiding tube,
a plurality of auditorily-snap-locking nipples respectively molded on said auditorily-snap-locking leaf springs
for auditorily-snap-locking inside said auditorily-snap-locking recess,
a plurality of threaded L-cross-sectional towers respectively molded to said at least one pin-centering-and-guiding plug,
a plurality of tower leaf springs respectively molded to said threaded L-cross-sectional towers, and
a tower-locking screw screwed between said threaded L-cross-sectional towers for pushing said threaded L-cross-sectional towers against said umbrella pole to lock said threaded L-cross-sectional towers and said at least one pin-centering-and-guiding tube inside said umbrella pole.

2. The arthritic-aiding pin-guiding auditorily-snap-locking umbrella of claim 1, wherein said tower leaf springs each have a triangular shape.

3. The arthritic-aiding pin-guiding auditorily-snap-locking umbrella of claim 1, wherein said threaded L-cross-sectional towers comprise four threaded L-cross sectional towers.

4. The arthritic-aiding pin-guiding auditorily-snap-locking umbrella of claim 1, wherein said at least one pin-centering-and-guiding plug comprises two pin-centering-and-guiding plugs.

5. The arthritic-aiding pin-guiding auditorily-snap-locking umbrella of claim 1, wherein said at least one pin-centering-and-guiding tube comprises two pin-centering-and guiding tubes.

6. The arthritic-aiding pin-guiding auditorily-snap-locking umbrella of claim 1, wherein said at least one pin opening comprises two pin openings.

7. The arthritic-aiding pin-guiding auditorily-snap-locking umbrella of claim 1, wherein said cord blocker comprises two L brackets and an hourglass-shaped pulley rotatably riveted to said two L brackets.

8. The arthritic-aiding pin-guiding auditorily-snap-locking umbrella of claim 1, wherein said cord blocker comprises a U-shaped bracket and two washers molded to said U-shaped bracket.

9. An arthritic-aiding pin-guiding umbrella comprising:

a canopy and pole system comprising:

a canopy, said canopy having a plurality of canopy openings, a plurality of upper ribs, each of said upper ribs having a rib tip, a plurality of lower ribs, a plurality of rib joints respectively attached to said upper ribs and pivotably attached to said lower ribs, a pole, said pole having a pole top, a fixed hub attached to said pole top and pivotably screwed to said upper ribs, a movable hub movably slid on said pole and pivotably screwed to said lower ribs, and a tubular elevator screwed to said movable hub;

a canopy-tension-adjusting system comprising:

a plurality of rod-locking washers, a plurality of tension-adjusting oval rib openings respectively drilled in said upper ribs, a plurality of externally-threaded rods respectively inserted into said rib tip of said upper ribs, a plurality of threaded rod openings respectively drilled in said externally-threaded rods, a plurality of internally-threaded tension-adjusting knobs respectively screwed on said externally-threaded rods, and a plurality of rod-locking screws respectively screwed through said rod-locking washers, through said canopy openings, through said tension-adjusting oval rib openings, and into said threaded rod openings for tensioning said canopy;

an arthritic-aiding tri-pulley system comprising:

two fixed pulleys respectively screwed to said fixed hub, a movable pulley screwed to said movable hub, a pulley cord threaded on said two fixed pulleys and said movable pulley, and attached to said movable hub, and a cord hook for said pulley cord to be releasably hooked thereon;

an anti-cable-fraying cable-locking system comprising:

a gear-cam mount screwed to said tubular elevator, two gear cams each having a tear-dropped shape for clampingly securing said pulley cord therebetween and allowing said pulley cord to move in only one direction therebetween, a cord blocker, and two gear-cam screws respectively screwed through said cord blocker, through said two gear cams, and onto said gear-cam mount; and an arthritic-aiding pin-centering-and-guiding system comprising:

at least one pin opening respectively drilled through said pole, an arthritic-aiding grip ring attached to said cord hook for aiding an arthritic use, an anti-finger-pinching spacer screwed on said cord hook, a locking pin molded to said anti-finger-pinching spacer, a recess molded on said locking pin, at least one pin-centering-and-guiding plug inserted into said pole, at least one pin-centering-and-guiding tube molded inside said at least one pin-centering-and-guiding plug and aligned with said at least one pin opening for centering said locking pin inside said at least one pin-centering-and-guiding tube and for guiding said locking pin through said at least one pin opening, a plurality of auditorily-snap-locking leaf springs molded inside said at least one pin-centering-and-guiding tube for auditorily-snap-locking inside said recess, a plurality of L-cross-sectional towers respectively molded to said at least one pin-centering-and-guiding plug, a plurality of tower leaf springs respectively molded to said L-cross-sectional towers, and a tower-locking screw screwed between said L-cross-sectional towers for pushing said L-cross-sectional towers against said pole to lock said L-cross-sectional towers and said at least one pin-centering-and-guiding tube inside said pole.

10. The arthritic-aiding pin-guiding umbrella of claim 9, wherein said tower leaf springs each have a triangular shape.

11. The arthritic-aiding pin-guiding umbrella of claim 9, wherein said L-cross-sectional towers comprise four L-cross-sectional towers.

12. The arthritic-aiding pin-guiding umbrella of claim 9, wherein said at least one pin-centering-and-guiding plug comprises four pin-centering-and-guiding plugs.

13. The arthritic-aiding pin-guiding umbrella of claim 9, wherein said at least one pin-centering-and-guiding tube comprises four pin-centering-and guiding tubes.

14. The arthritic-aiding pin-guiding umbrella of claim 9, wherein said at least one pin opening comprises four pin openings.

15. The arthritic-aiding pin-guiding umbrella of claim 9, wherein said cord blocker comprises two L brackets and an hourglass-shaped pulley rotatably riveted to said two L brackets.

16. The arthritic-aiding pin-guiding umbrella of claim 9, wherein said cord blocker comprises a U-shaped bracket and two washers molded to said U-shaped bracket.

17. A pin-guiding umbrella comprising:

a canopy and pole system comprising:

a canopy, said canopy having a plurality of canopy openings, a plurality of upper ribs, each of said upper ribs having a rib tip, a plurality of lower ribs, a plurality of joints respectively attached to said upper ribs and pivotably attached to said lower ribs, a pole, said pole having a pole top, a fixed hub attached to said pole top and pivotably screwed to said upper ribs, a movable hub movably slid on said pole and pivotably screwed to said lower ribs, and a tubular elevator screwed to said movable hub;

a tension-adjusting system comprising:

a plurality of washers, a plurality of threaded rib openings respectively drilled in said upper ribs, and a plurality of screws respectively screwed through said washers, through said canopy openings, and into said threaded rib openings for tensioning said canopy;

a tri-pulley system comprising:

two fixed pulleys respectively screwed to said fixed hub, a movable pulley screwed to said movable hub, a cord threaded on said two fixed pulleys and said movable pulley, and attached to said movable hub, and a hook for said pulley cord to be releasably hooked thereon;

an anti-cable-fraying cable-locking system comprising:

a mount screwed to said tubular elevator, two gear cams each having a tear-dropped shape for clampingly securing said cord therebetween and allowing said cord to move in only one direction therebetween, a cord blocker, and two gear-cam screws respectively screwed through said cord blocker, through said two gear cams, and onto said mount; and an arthritic-aiding pin-guiding system comprising:

at least one pin opening respectively drilled through said pole, a pin screwed on said hook, a recess molded on said pin, at least one pin-guiding plug inserted into said pole, at least one pin-guiding tube molded inside said at least one pin-guiding plug and aligned with said at least one pin opening for centering said pin inside said at least one pin-guiding tube and for guiding said pin through said at least one pin opening, a plurality of leaf springs molded inside said at least one pin-guiding tube for auditorily-snap-locking inside said recess, a plurality of towers respectively molded to said at least one pin-guiding plug, a plurality of tower springs respectively molded to said towers, and a tower screw screwed between said towers for pushing said towers against said pole to lock said towers and said at least one pin-guiding tube inside said pole.

18. The pin-guiding umbrella of claim 17, wherein said cord is attached to said pin.

* * * * *